US008104212B2

(12) United States Patent
Potterfield et al.

(10) Patent No.: US 8,104,212 B2
(45) Date of Patent: Jan. 31, 2012

(54) FIREARM SUPPORTS, SUCH AS SHOOTING BAGS, AND FIREARM SUPPORT ASSEMBLIES

(75) Inventors: Russell A. Potterfield, Columbia, MO (US); Tim Morrow, Jefferson City, MO (US); Brook Banham, San Francisco, CA (US)

(73) Assignee: Battenfeld Technologies, Inc., Columbia, MO (US)

( * ) Notice: Subject to any disclaimer, the term of this patent is extended or adjusted under 35 U.S.C. 154(b) by 0 days.

(21) Appl. No.: 11/679,100

(22) Filed: Feb. 26, 2007

(65) Prior Publication Data

US 2008/0034636 A1 Feb. 14, 2008

Related U.S. Application Data

(60) Provisional application No. 60/776,296, filed on Feb. 24, 2006.

(51) Int. Cl.
*F41C 27/00* (2006.01)

(52) U.S. Cl. ..... 42/94

(58) Field of Classification Search ..... 42/94; 73/167; 89/37.04

See application file for complete search history.

(56) References Cited

U.S. PATENT DOCUMENTS

| | | | |
|---|---|---|---|
| 197,397 | A | 11/1877 | O'Neil |
| 387,411 | A | 8/1888 | Gisel |
| 399,604 | A | 3/1889 | Dufner et al. |
| 499,315 | A | 6/1893 | Borchardt |
| 568,543 | A | 9/1896 | Parks |
| 668,219 | A | 2/1901 | Rock |
| 691,912 | A | 1/1902 | McClean |
| 718,865 | A | 1/1903 | Northcraft |
| 778,865 | A | 1/1905 | Hyenga |
| 789,909 | A | 5/1905 | Herold |
| 1,033,624 | A | 7/1912 | Schmeisser |
| 1,061,577 | A | 5/1913 | Whitney |
| 1,088,362 | A | 2/1914 | Perkins |
| 1,089,307 | A | 3/1914 | Benet et al. |
| 1,121,945 | A | 12/1914 | Smith |
| 1,145,585 | A | 7/1915 | Hebard |
| 1,175,692 | A | 3/1916 | Boicourt |
| 1,195,777 | A | 8/1916 | Burtin |
| 1,250,215 | A | 12/1917 | Panos |
| 1,256,255 | A | 2/1918 | Porter |
| 1,295,688 | A | 2/1919 | Butler |
| 1,367,353 | A | 2/1921 | Craig |

(Continued)

FOREIGN PATENT DOCUMENTS

| | | |
|---|---|---|
| DE | 838872 | 5/1952 |

(Continued)

OTHER PUBLICATIONS

U.S. Appl. No. 11/431,956, filed May 10, 2006, Morrow et al.

(Continued)

*Primary Examiner* — Stephen M Johnson
*Assistant Examiner* — Daniel Troy
(74) *Attorney, Agent, or Firm* — Perkins Coie LLP

(57) ABSTRACT

Firearm supports (e.g., firearm shooting bags) and firearm support assemblies are disclosed herein. In one embodiment, a firearm support includes a generally pliable cover at least partially enclosing an internal space, and a generally inflexible support structure coupled to the pliable cover and configured to assist the pliable cover in maintaining a particular shape.

11 Claims, 7 Drawing Sheets

U.S. PATENT DOCUMENTS

| | | | |
|---|---|---|---|
| 1,488,647 | A | 4/1924 | Quinn |
| 1,639,722 | A | 8/1927 | Whitney |
| 1,693,289 | A | 11/1928 | Warren |
| 1,736,244 | A | 11/1929 | Baker |
| 1,902,040 | A | 3/1933 | Meyer |
| 1,907,181 | A | 5/1933 | Fey |
| 1,927,876 | A | 9/1933 | Meyer |
| 1,928,871 | A | 10/1933 | Swebilius |
| 2,066,218 | A | 12/1936 | Morgan |
| 2,079,510 | A | 5/1937 | King et al. |
| 2,090,930 | A | 8/1937 | Chubb |
| 2,100,514 | A | 11/1937 | Miller |
| 2,121,982 | A | 6/1938 | Pugsley |
| 2,125,353 | A | 8/1938 | Mattson |
| 2,216,766 | A | 10/1940 | Cook |
| 2,232,743 | A | 2/1941 | Swenson |
| 2,297,993 | A | 10/1942 | Tratsch |
| 2,331,372 | A | 10/1943 | Buchanan |
| 2,378,545 | A | 6/1945 | Fraser et al. |
| D147,305 | S | 8/1947 | Sloan |
| 2,432,519 | A | 12/1947 | Garand |
| 2,451,266 | A | 10/1948 | Whittemore |
| 2,455,644 | A | 12/1948 | Barnes |
| 2,476,078 | A | 7/1949 | Banks |
| 2,479,354 | A | 8/1949 | Hanson |
| 2,483,089 | A | 9/1949 | Ferguson |
| 2,484,801 | A | 10/1949 | Anderson |
| 2,508,951 | A | 5/1950 | Kazimier |
| 2,510,380 | A | 6/1950 | Clifford |
| 2,517,268 | A | 8/1950 | Wilson |
| 2,638,676 | A | 5/1953 | Callahan |
| 2,677,207 | A | 5/1954 | Stewart |
| 2,701,930 | A | 2/1955 | Dolan |
| 2,731,829 | A | 1/1956 | Wigington et al. |
| 2,740,530 | A | 4/1956 | Ponder |
| 2,753,642 | A | 7/1956 | Sullivan |
| 2,774,563 | A | 12/1956 | Pribis |
| 2,795,881 | A | 6/1957 | Bellows |
| 2,813,376 | A | 11/1957 | Middlemark |
| 2,817,233 | A | 12/1957 | Dower et al. |
| 2,821,117 | A | 1/1958 | Hultgren |
| 2,847,909 | A | 8/1958 | Kester |
| 2,867,931 | A | 1/1959 | Schreiber |
| 2,877,689 | A | 3/1959 | Pribis |
| 2,894,347 | A | 7/1959 | Woodcock |
| 2,924,881 | A | 2/1960 | Gee |
| 2,924,904 | A | 2/1960 | Amsler |
| 2,924,914 | A | 2/1960 | Garwood |
| 2,975,540 | A | 3/1961 | Lewis |
| 2,999,788 | A | 9/1961 | Morgan |
| 3,011,283 | A | 12/1961 | Lunn et al. |
| 3,012,350 | A | 12/1961 | Wold |
| 3,023,527 | A | 3/1962 | Leek et al. |
| 3,024,653 | A | 3/1962 | Broadway |
| 3,041,938 | A | 7/1962 | Seabrook |
| 3,055,655 | A | 9/1962 | Chelf |
| 3,060,612 | A | 10/1962 | Brown et al. |
| 3,112,567 | A | 12/1963 | Flanagan |
| 3,125,929 | A | 3/1964 | Peasley |
| 3,128,668 | A | 4/1964 | Dicken |
| 3,163,420 | A | 12/1964 | Braun |
| 3,175,456 | A | 3/1965 | Goodsell |
| 3,183,617 | A | 5/1965 | Ruger et al. |
| 3,206,885 | A | 9/1965 | Dye |
| 3,225,656 | A | 12/1965 | Flaherty et al. |
| D203,680 | S | 2/1966 | Benchrest |
| 3,240,103 | A | 3/1966 | Lamont |
| 3,259,986 | A | 7/1966 | Can |
| 3,283,425 | A | 11/1966 | Boyd |
| 3,283,643 | A | 11/1966 | Mittelsteadt |
| 3,291,317 | A | 12/1966 | Bowen |
| 3,292,293 | A | 12/1966 | Chiasera et al. |
| 3,320,848 | A | 5/1967 | Ponsness |
| 3,323,246 | A | 6/1967 | Loffler |
| 3,327,422 | A | 6/1967 | Harris |
| 3,330,561 | A | 7/1967 | Kandel |
| 3,343,411 | A | 9/1967 | Lee |
| 3,353,827 | A | 11/1967 | Dun, Jr. |
| 3,370,852 | A | 2/1968 | Kandel |
| 3,406,969 | A | 10/1968 | Tisdell et al. |
| 3,423,092 | A | 1/1969 | Kandel |
| D215,311 | S | 9/1969 | Born |
| 3,486,752 | A | 12/1969 | Colvin |
| 3,499,525 | A | 3/1970 | Kanter |
| 3,510,951 | A | 5/1970 | Dow |
| 3,513,604 | A | 5/1970 | Matsunaga et al. |
| 3,550,941 | A | 12/1970 | Spiro et al. |
| 3,556,666 | A | 1/1971 | Lichenstern |
| D220,154 | S | 3/1971 | Irelan |
| 3,572,712 | A | 3/1971 | Vick |
| 3,580,127 | A | 5/1971 | Lee |
| 3,583,556 | A | 6/1971 | Wagner |
| 3,584,820 | A | 6/1971 | Butcher, Sr. |
| 3,587,193 | A | 6/1971 | Lewis |
| 3,608,225 | A | 9/1971 | Manuel |
| 3,680,266 | A | 8/1972 | Shiplov |
| 3,680,354 | A | 8/1972 | Phillips, Jr. |
| 3,711,955 | A | 1/1973 | Holt |
| 3,711,984 | A | 1/1973 | Dyer et al. |
| 3,739,515 | A | 6/1973 | Koon, Jr. |
| 3,744,292 | A | 7/1973 | Michelson |
| 3,745,875 | A | 7/1973 | Kennedy et al. |
| 3,748,950 | A | 7/1973 | Huntington |
| 3,764,219 | A | 10/1973 | Collins |
| 3,769,758 | A | 11/1973 | McDonald |
| 3,813,816 | A | 6/1974 | Funk |
| 3,815,270 | A | 6/1974 | Pachmayr |
| 3,826,559 | A | 7/1974 | Berliner et al. |
| 3,827,172 | A | 8/1974 | Howe |
| 3,842,527 | A | 10/1974 | Low |
| D233,853 | S | 12/1974 | Ferrara |
| 3,877,178 | A | 4/1975 | Campanelli |
| 3,885,357 | A | 5/1975 | Hoyt |
| 3,893,266 | A | 7/1975 | Anderson et al. |
| 3,895,803 | A | 7/1975 | Loe |
| 3,899,175 | A | 8/1975 | Loe |
| D237,106 | S | 10/1975 | Baljet et al. |
| 3,913,746 | A | 10/1975 | Burton |
| 3,914,879 | A | 10/1975 | Taylor, III et al. |
| 3,935,657 | A * | 2/1976 | Wade ..... 42/94 |
| 3,947,988 | A | 4/1976 | Besaw |
| 3,949,987 | A | 4/1976 | Candor |
| 3,961,436 | A | 6/1976 | Hagen et al. |
| 3,964,613 | A | 6/1976 | Anderson, Jr. |
| 3,979,849 | A | 9/1976 | Haskins |
| 4,007,554 | A | 2/1977 | Helmstadter |
| 4,012,860 | A | 3/1977 | Auger |
| 4,021,971 | A | 5/1977 | McFadden |
| 4,026,057 | A | 5/1977 | Cady |
| 4,027,781 | A | 6/1977 | Covert |
| 4,042,242 | A | 8/1977 | Nicholls et al. |
| 4,054,288 | A | 10/1977 | Perrine, Sr. |
| 4,055,016 | A | 10/1977 | Katsenes |
| 4,072,313 | A | 2/1978 | Murso et al. |
| 4,076,247 | A | 2/1978 | Kim et al. |
| 4,120,108 | A | 10/1978 | Vickers et al. |
| 4,120,276 | A | 10/1978 | Curran |
| 4,122,623 | A | 10/1978 | Stice |
| 4,143,491 | A | 3/1979 | Blanc |
| 4,177,608 | A | 12/1979 | Balz |
| 4,188,855 | A | 2/1980 | Alberts |
| 4,203,600 | A | 5/1980 | Brown |
| 4,206,573 | A | 6/1980 | Hayward |
| 4,222,305 | A | 9/1980 | Lee |
| 4,223,588 | A | 9/1980 | Simpson |
| 4,233,748 | A | 11/1980 | Ford et al. |
| D257,687 | S | 12/1980 | Bechtel |
| 4,266,748 | A | 5/1981 | Dalton |
| 4,282,671 | A | 8/1981 | Wood et al. |
| D260,650 | S | 9/1981 | Alviti |
| D261,794 | S | 11/1981 | Bechtel |
| 4,301,625 | A | 11/1981 | Rampe |
| 4,312,146 | A | 1/1982 | Koon, Jr. |
| 4,332,185 | A | 6/1982 | Hargrove |
| 4,333,385 | A | 6/1982 | Culver |
| 4,338,726 | A | 7/1982 | Swailes |
| 4,340,370 | A | 7/1982 | Marshall et al. |

4,345,398 A 8/1982 Pickett
4,346,530 A 8/1982 Stewart et al.
4,359,833 A 11/1982 Pachmayr et al.
4,385,464 A 5/1983 Casull
4,385,545 A 5/1983 Duer
4,391,058 A 7/1983 Casull
4,392,321 A 7/1983 Bosworth
4,407,379 A 10/1983 Pryor et al.
4,409,751 A 10/1983 Goda et al.
4,438,913 A 3/1984 Hylla
4,449,314 A 5/1984 Sorensen
4,462,598 A 7/1984 Chalin et al.
4,477,082 A 10/1984 McKenzie et al.
4,480,411 A 11/1984 Balz et al.
4,506,466 A 3/1985 Hall
4,508,508 A 4/1985 Theodore
4,512,101 A 4/1985 Waterman, Jr.
4,522,102 A 6/1985 Pickens
4,526,084 A 7/1985 David et al.
4,542,677 A 9/1985 Lee
4,548,392 A 10/1985 Rickling
4,558,531 A 12/1985 Kilby
D283,561 S 4/1986 Geist et al.
4,601,124 A 7/1986 Brown, Jr.
4,608,762 A 9/1986 Varner
4,621,563 A 11/1986 Poiencot
4,625,620 A 12/1986 Harris
4,632,008 A 12/1986 Horner
4,644,987 A 2/1987 Kiang et al.
4,648,191 A 3/1987 Goff et al.
4,653,210 A 3/1987 Poff, Jr.
4,671,364 A 6/1987 Fink et al.
4,674,216 A 6/1987 Ruger et al.
4,695,060 A 9/1987 Pilgrim
4,696,356 A 9/1987 Ellion et al.
4,702,029 A 10/1987 DeVaul et al.
4,721,205 A 1/1988 Burt et al.
4,723,472 A 2/1988 Lee
4,729,186 A 3/1988 Rieger et al.
4,751,963 A 6/1988 Bui et al.
D297,855 S 9/1988 Ruger et al.
4,776,471 A 10/1988 Elkins
4,790,079 A 12/1988 Meyers
4,790,096 A 12/1988 Gibson et al.
4,799,324 A 1/1989 Nodo
4,807,381 A 2/1989 Southard
4,815,593 A 3/1989 Brown
4,819,359 A 4/1989 Bassett
4,821,422 A 4/1989 Porter
4,821,443 A * 4/1989 Bianco ..... 42/94
4,823,673 A 4/1989 Downing
4,824,086 A 4/1989 Rickling et al.
4,841,839 A 6/1989 Stuart
4,850,151 A 7/1989 Ditscherlein
4,854,066 A 8/1989 Canterbury, Sr.
4,862,567 A 9/1989 Beebe
D304,223 S 10/1989 Ruger et al.
4,873,777 A 10/1989 Southard
4,890,847 A 1/1990 Cartee et al.
4,896,446 A 1/1990 Gregory
D306,234 S 2/1990 Ferstl et al.
4,903,425 A 2/1990 Harris
4,910,904 A 3/1990 Rose
4,918,825 A 4/1990 Lesh et al.
4,921,256 A 5/1990 Gearhart
4,923,402 A 5/1990 Marshall et al.
4,924,616 A * 5/1990 Bell ..... 42/94
4,937,965 A 7/1990 Narvaez
D310,302 S 9/1990 Southard
4,967,497 A 11/1990 Yakscoe
4,971,208 A 11/1990 Reinfried, Jr. et al.
4,972,619 A * 11/1990 Eckert ..... 42/94
D313,886 S 1/1991 Southard
4,987,694 A 1/1991 Lombardo
4,998,367 A 3/1991 Leibowitz
4,998,944 A 3/1991 Lund
5,005,657 A 4/1991 Ellion et al.
5,009,021 A 4/1991 Nelson
5,014,793 A 5/1991 Germanton et al.
5,031,348 A 7/1991 Carey
5,050,330 A 9/1991 Pilgrim et al.
5,058,302 A 10/1991 Minneman
5,060,410 A 10/1991 Mueller
5,063,679 A 11/1991 Schwandt
5,067,268 A 11/1991 Ransom
5,070,636 A 12/1991 Mueller
5,074,188 A 12/1991 Harris
5,081,783 A 1/1992 Jarvis
5,117,850 A 6/1992 Money
5,123,194 A 6/1992 Mason
5,125,389 A 6/1992 Paff
5,149,900 A 9/1992 Buck
5,173,563 A 12/1992 Gray
5,180,874 A 1/1993 Troncoso, Jr
5,185,927 A 2/1993 Rivers
5,186,468 A 2/1993 Davies
5,188,371 A 2/1993 Edwards
D335,896 S 5/1993 Evenson
5,211,404 A 5/1993 Grant
5,221,806 A 6/1993 Chaney et al.
5,222,306 A 6/1993 Neumann
5,228,887 A 7/1993 Mayer et al.
5,233,779 A 8/1993 Shaw
5,235,764 A 8/1993 Perazzi et al.
5,237,778 A 8/1993 Baer
5,247,758 A 9/1993 Mason
5,271,175 A 12/1993 West, III
5,275,890 A 1/1994 Wolf et al.
5,287,643 A 2/1994 Arizpe-Gilmore
5,311,693 A 5/1994 Underwood
5,315,781 A 5/1994 Beisner
5,316,579 A 5/1994 McMillan et al.
5,317,826 A 6/1994 Underwood
5,320,217 A 6/1994 Lenarz
5,328,029 A 7/1994 Chow et al.
5,332,185 A * 7/1994 Walker, III ..... 248/346.2
5,333,829 A 8/1994 Bell et al.
5,335,578 A 8/1994 Lorden et al.
5,344,012 A 9/1994 Matthews
5,347,740 A 9/1994 Rather et al.
5,351,428 A 10/1994 Graham
5,358,254 A 10/1994 Yeh et al.
5,361,505 A 11/1994 Faughn
5,367,232 A 11/1994 Netherton et al.
5,370,240 A 12/1994 Hand
5,375,337 A 12/1994 Butler
5,375,377 A 12/1994 Kenton
5,377,437 A 1/1995 Underwood
5,392,553 A 2/1995 Carey
5,402,595 A 4/1995 Tamllos
5,406,733 A 4/1995 Tarlton et al.
5,410,833 A 5/1995 Paterson
5,414,949 A 5/1995 Peebles
D359,392 S 6/1995 Bellington
5,421,115 A 6/1995 McKay
5,433,010 A 7/1995 Bell
5,435,223 A 7/1995 Blodgett et al.
5,442,860 A 8/1995 Palmer
D362,116 S 9/1995 Bellington et al.
D364,080 S 11/1995 Weyrauch
5,481,817 A 1/1996 Parker
5,482,241 A 1/1996 Oglesby
5,486,135 A 1/1996 Arpaio
5,490,302 A * 2/1996 Dion ..... 15/210.1
5,491,921 A 2/1996 Allen
5,497,557 A 3/1996 Martinsson et al.
5,497,575 A 3/1996 Fried et al.
5,501,467 A 3/1996 Kandel
D369,904 S 5/1996 Taylor
5,545,855 A 8/1996 Stanfield et al.
5,562,208 A 10/1996 Hasler et al.
D375,538 S 11/1996 Minneman
5,570,513 A 11/1996 Peterson
5,580,063 A 12/1996 Edwards
5,600,913 A * 2/1997 Minneman ..... 42/94
5,617,666 A 4/1997 Scott
5,622,344 A 4/1997 Gracie
5,628,135 A 5/1997 Cady

| | | | |
|---|---|---|---|
| 5,640,944 | A | 6/1997 | Minneman |
| 5,644,862 | A | 7/1997 | Folmer |
| 5,649,465 | A | 7/1997 | Beebe |
| 5,653,625 | A | 8/1997 | Pierce et al. |
| 5,661,919 | A | 9/1997 | Pryor |
| 5,662,516 | A | 9/1997 | You |
| 5,666,757 | A | 9/1997 | Helmstadter |
| D387,123 | S | 12/1997 | Hughes et al. |
| 5,703,317 | A | 12/1997 | Levilly et al. |
| 5,711,102 | A | 1/1998 | Plaster et al. |
| 5,715,625 | A | 2/1998 | West, III |
| D391,616 | S | 3/1998 | Plybon |
| 5,723,183 | A | 3/1998 | Williams et al. |
| 5,723,806 | A | 3/1998 | Odom |
| 5,737,865 | A | 4/1998 | Brandl et al. |
| 5,740,625 | A | 4/1998 | Jenkins |
| 5,758,447 | A | 6/1998 | Venetz |
| 5,758,933 | A | 6/1998 | Clendening |
| 5,761,954 | A | 6/1998 | Dvorak |
| 5,778,589 | A | 7/1998 | Teague |
| 5,779,527 | A | 7/1998 | Maebashi |
| 5,811,720 | A | 9/1998 | Quinnell et al. |
| 5,813,131 | A | 9/1998 | Werre |
| 5,815,974 | A | 10/1998 | Keng |
| 5,833,308 | A | 11/1998 | Strong, III et al. |
| D403,176 | S | 12/1998 | Harper |
| 5,857,279 | A | 1/1999 | de Oliveira Masina et al. |
| 5,875,580 | A | 3/1999 | Hill et al. |
| 5,878,504 | A | 3/1999 | Harms |
| 5,884,966 | A | 3/1999 | Hill et al. |
| 5,899,329 | A | 5/1999 | Hu et al. |
| 5,907,919 | A | 6/1999 | Keeney |
| 5,913,667 | A | 6/1999 | Smilee |
| 5,913,668 | A | 6/1999 | Messer |
| 5,924,694 | A | 7/1999 | Kent |
| 5,930,932 | A | 8/1999 | Peterson |
| 5,933,997 | A | 8/1999 | Barrett |
| 5,933,999 | A | 8/1999 | McClure et al. |
| 5,959,613 | A | 9/1999 | Rosenberg et al. |
| 5,970,642 | A | 10/1999 | Martin |
| 5,974,719 | A | 11/1999 | Simonek |
| 6,019,375 | A | 2/2000 | West, Jr. |
| 6,021,891 | A | 2/2000 | Anderson |
| 6,044,747 | A | 4/2000 | Felts |
| 6,058,641 | A | 5/2000 | Vecqueray |
| 6,073,381 | A | 6/2000 | Farrar et al. |
| 6,086,375 | A | 7/2000 | Legros |
| 6,110,020 | A | 8/2000 | Rolfi |
| 6,121,556 | A | 9/2000 | Cole |
| 6,237,462 | B1 | 5/2001 | Hawkes et al. |
| 6,254,100 | B1 | 7/2001 | Rinehart |
| 6,260,463 | B1 | 7/2001 | Brand et al. |
| 6,283,428 | B1 | 9/2001 | Maples et al. |
| 6,289,622 | B1 | 9/2001 | Desch, Jr. et al. |
| 6,293,041 | B2 | 9/2001 | Weaver |
| 6,294,759 | B1 | 9/2001 | Dunn, Jr. |
| 6,305,117 | B1 | 10/2001 | Hales, Sr. |
| 6,309,476 | B1 | 10/2001 | Ravenscroft et al. |
| 6,338,218 | B1 | 1/2002 | Hegler |
| 6,390,294 | B1 | 5/2002 | Fiore, Jr. et al. |
| 6,397,720 | B1 | 6/2002 | Fox et al. |
| 6,439,515 | B1 | 8/2002 | Powers |
| 6,439,530 | B1 | 8/2002 | Schoenfish et al. |
| 6,517,133 | B2 | 2/2003 | Seegmiller et al. |
| D471,248 | S | 3/2003 | Jacobs |
| 6,526,687 | B1 | 3/2003 | Looney |
| D473,376 | S | 4/2003 | Abate |
| 6,546,662 | B1 | 4/2003 | Chong |
| 6,574,899 | B1 | 6/2003 | Mostello |
| 6,575,469 | B2 | 6/2003 | Love |
| 6,643,973 | B1 | 11/2003 | Smith |
| 6,663,298 | B2 | 12/2003 | Haney |
| 6,688,031 | B2 | 2/2004 | Steele |
| 6,736,400 | B1 | 5/2004 | Cesternino |
| 6,813,855 | B2 | 11/2004 | Pinkley |
| 6,814,654 | B2 | 11/2004 | Rolfi |
| 6,854,975 | B2 | 2/2005 | Ranzinger |
| 6,860,054 | B1 | 3/2005 | Mosher |
| 6,862,833 | B1 | 3/2005 | Gurtner |
| 6,871,440 | B2 | 3/2005 | Highfill et al. |
| 6,877,266 | B1 | 4/2005 | Brownlee |
| 6,883,263 | B1 | 4/2005 | Carrow |
| 6,931,777 | B1 * | 8/2005 | Krien ..... 42/94 |
| 6,953,114 | B2 | 10/2005 | Wang et al. |
| D513,055 | S | 12/2005 | Lahti |
| 6,978,569 | B2 | 12/2005 | Williamson, IV et al. |
| D519,183 | S | 4/2006 | Minneman |
| 7,032,494 | B2 | 4/2006 | Wygant |
| D521,100 | S | 5/2006 | Morrow |
| D524,541 | S | 7/2006 | Cauley |
| 7,086,192 | B2 | 8/2006 | Deros |
| 7,104,398 | B1 | 9/2006 | Wisecarver |
| 7,134,663 | B1 | 11/2006 | Lowe et al. |
| 7,143,986 | B1 | 12/2006 | Austin et al. |
| 7,152,355 | B2 | 12/2006 | Fitzpatrick et al. |
| 7,152,358 | B1 | 12/2006 | LeAnna et al. |
| 7,159,711 | B1 | 1/2007 | Gardner |
| D540,904 | S | 4/2007 | Werner |
| 7,207,567 | B1 | 4/2007 | Brown |
| 7,225,050 | B2 | 5/2007 | Sutula, Jr. |
| D553,219 | S | 10/2007 | Potterfield |
| 7,281,346 | B1 | 10/2007 | Cook et al. |
| D567,895 | S | 4/2008 | Cauley |
| 7,357,250 | B2 | 4/2008 | Hagemann et al. |
| 7,363,740 | B2 | 4/2008 | Kincel |
| 7,401,431 | B2 | 7/2008 | Pierce et al. |
| D576,245 | S | 9/2008 | Potterfield et al. |
| 7,426,800 | B2 | 9/2008 | Pierce et al. |
| 7,584,690 | B2 | 9/2009 | Cauley |
| 2002/0113372 | A1 | 8/2002 | Love |
| 2004/0020097 | A1 | 2/2004 | Deros |
| 2004/0134113 | A1 | 7/2004 | Deros et al. |
| 2005/0000141 | A1 | 1/2005 | Cauley et al. |
| 2005/0011101 | A1 | 1/2005 | Gooder |
| 2005/0115137 | A1 | 6/2005 | Minneman |
| 2005/0183319 | A1 | 8/2005 | Franks |
| 2005/0188597 | A1 | 9/2005 | Keng et al. |
| 2005/0242250 | A1 | 11/2005 | Keng et al. |
| 2006/0174532 | A1 | 8/2006 | Popikow |
| 2006/0175213 | A1 | 8/2006 | Hurt et al. |
| 2006/0218840 | A1 | 10/2006 | Cauley |
| 2006/0248774 | A1 | 11/2006 | Pierce et al. |
| 2006/0248775 | A1 | 11/2006 | Wade et al. |
| 2006/0254111 | A1 | 11/2006 | Giauque et al. |
| 2006/0278797 | A1 | 12/2006 | Keng et al. |
| 2007/0029733 | A1 | 2/2007 | Anderson |
| 2007/0046760 | A1 | 3/2007 | Zara |
| 2007/0068379 | A1 | 3/2007 | Sween et al. |
| 2007/0074439 | A2 | 4/2007 | Cauley et al. |
| 2007/0074440 | A2 | 4/2007 | Cauley |
| 2007/0094911 | A1 | 5/2007 | Rush et al. |
| 2007/0113460 | A1 | 5/2007 | Potterfield et al. |
| 2007/0175077 | A1 | 8/2007 | Laney et al. |
| 2007/0256346 | A1 | 11/2007 | Potterfield et al. |
| 2007/0262529 | A1 | 11/2007 | Gamez et al. |
| 2007/0266610 | A1 | 11/2007 | Coffield |
| 2007/0294929 | A1 | 12/2007 | Potterfield et al. |
| 2007/0295197 | A1 | 12/2007 | Potterfield |
| 2008/0023379 | A1 | 1/2008 | Potterfield et al. |
| 2008/0023915 | A1 | 1/2008 | Morrow et al. |
| 2008/0041700 | A1 | 2/2008 | Potterfield et al. |
| 2008/0047189 | A1 | 2/2008 | Potterfield et al. |
| 2008/0054570 | A1 | 3/2008 | Potterfield et al. |
| 2008/0061509 | A1 | 3/2008 | Potterfield |
| 2008/0127815 | A1 | 6/2008 | Yale et al. |
| 2008/0168697 | A1 | 7/2008 | Potterfield et al. |
| 2008/0174071 | A1 | 7/2008 | Potterfield et al. |
| 2009/0049731 | A1 | 2/2009 | Seuk |
| 2009/0056192 | A1 | 3/2009 | Oz |
| 2009/0126250 | A1 | 5/2009 | Keng |

FOREIGN PATENT DOCUMENTS

| | | |
|---|---|---|
| EP | 0624455 | 11/1994 |
| GB | 475080 | 11/1937 |

OTHER PUBLICATIONS

U.S. Appl. No. 11/505,784, filed Aug. 16, 2006, Cauley.
U.S. Appl. No. 11/679,832, filed Feb. 27, 2007, Cauley et al.
U.S. Appl. No. 11/739,077, filed Apr. 23, 2007, Cauley et al.
U.S. Appl. No. 11/801,341, filed Apr. 23, 2007, Potterfield et al.
U.S. Appl. No. 11/862,821, filed Sep. 27, 2007, Cesternino.
U.S. Appl. No. 11/935,381, filed Nov. 5, 2007, Potterfield.
U.S. Appl. No. 11/937,466, filed Nov. 8, 2007, Potterfield et al.
U.S. Appl. No. 12/037,336, filed Feb. 26, 2008, Potterfield.
U.S. Appl. No. 12/117,668, filed May 8, 2008, Potterfield et al.
U.S. Appl. No. 12/172,848, filed Jul. 14, 2008, Cesternino et al.
U.S. Appl. No. 12/177,032, filed Jul. 21, 2008, Potterfield et al.
"American Rifleman: What to do about recoil," LookSmart, http://www.findarticles.com/p/articles/mi_qa3623/is_199907/ai_n8861959/print, pp. 1-4 [Internet accessed on Jan. 4, 2006].
"Cleaning Cradles: Sinclaire Cleaning Cradles," p. 21, The date on which the Sinclair Folding Cleaning Cradle was first on sale is not known, but is believed to be circa 2004.
"Decker Rifle Vise," 1 page, The date on which the Decker Rifle Vise was first on sale is not known but is believed to be circa 2004.
Amazon.com, "Eforcity Magnetic Screwdriver Set w/15 bits; Great for Cellphones, Computers; Includes: T6, Torx, Security Torx, Philips, Slotted, Spanner, Tri-Wing, Bent Pry Tool, Round Awl, Reset Pin for Game Boy Advance, Nintendo Wii, DS Lite, NDS, Apple TV," 1 page [Internet accessed on Sep. 18, 2007].
Battenfeld Technologies, Inc., "Gun Vise," Tipton Gun Cleaning Supplies, Battenfeld Technologies, Inc. 2004 Catalog, p. 32, Product No. 782-731, 2 pgs.
"The Grabber and Hustler '76," MEC—Mayville Engineering Company, Inc., 2 pgs., undated.
1shop2.com "Hoppe's Gunsmith's Fully Adjustable Bench Vise," http://www.1shop2.com/outdoor_sports/Hoppe's—Gunsmith's-Fully-Adj . . . , 3 pgs, The date on which the Hoppe's Gunsmith's Fully Adjustable Bench Vise was first on sale is not known, but is believed to be circa 2004.
AcuSport, Outdoor Sporting Products, 3 pgs., undated.
Battenfeld Technologies, Inc., "Steady Rest Portable Shooting Rest," 1 page [Internet accessed Jul. 25, 2006].
Birchwood Casey 2005 Catalog, 28 pages.
Birchwood Casey 2006 Catalog, pp. 5-17.
Birchwood Casey, "Dirty Bird® Splattering Targets," http://www.birchwoodcasey.com/sport/target_index.asp?categoryID=4&subcat=22, pp. 1-4 [Internet accessed Jan. 16, 2006].
Birchwood Casey, "Shoot•N•C® Targets," http://www.birchwoodcasey.com/sport/target_index.asp?categoryID=4&subcat=8, pp. 1-8 [Internet accessed Jan. 16, 2006].
Birchwood Casey, "Targets Spots®," http://www.birchwoodcasey.com/sport_index.asp?categoryID=4&subcat=12, pp. 1-2 [Internet accessed Jan. 16, 2006].
Birchwood Casey, "World of Targets®," http://www.birchwoodcasey.com/sport/target_index.asp?categoryID=4&subcat=13, pp. 1-4 [Internet accessed Jan. 16, 2006].
Brownells, Inc., "Brownells Magna-Tip Screwdriver," Brownells Catalog No. 54, 2001-2002, p. 151.
Brownells, Inc., "Brownells Magna-Tip Super-Sets," Brownells Catalog No. 54, 2001-2002, p. 153.
Brownells, Inc., Catalog No. 41, 1988-1989, 3 pgs.
Brownells, Inc., Catalog No. 47, 1994-1995, 2 pgs.
Brownells, Inc., Catalog No. 57, 2004-2005. 2 pgs.
Brownells, Inc., Sight Base Cutters, Faxed Dec. 17, 2003, 1 page.
B-Square, Pro Gunsmith Screwdriver Set, B-Square Mounts Tools Accessories Product Catalog, p. 23, date unknown.
Cabela's Master Catalog, Fall 2002, Edition II, p. 416.
Cabela's Master Catalog, Fall 2003, Late-Season Edition, p. 416.
Cabela's, "HySkore Sighting System and Cleaning Vise," The date on which the HySkore Sighting System and Cleaning Vise was first on sale is not known, but is believed to be circa Jan. 2005, however, a prototype of this product may have been shown to buyers at Cabela's circa Aug. 2004, 1 page.
Caldwell Insta-View™ 4 Targets.
Caldwell™ Shooting Supplies, Targets & Target Accessories, Instra-View™ Targets, 1 page.
Californiavarmintcallers.com—Forum, http://californiavarmintcallers.com/community/modules/newbb/viewtopic.php?topic_id=10&forum=9&PHPSESSID=074ed8c7 . . . , pp. 1-4 [Internet accessed Jan. 16, 2006].
Champion Target, "Next Generation Paper Targets," http://www.championtarget.com/products/targets/next_generation_targets.aspx, pp. 1-3, [Internet accessed on Jan. 16, 2006].
Champion Traps & Target, 2005 Product Catalog, 12 pgs.
Ellett Brothers, Rests & Gun Vises, pp. 621-622, date unknown.
Lohman Sight Vise, 4 pages product photographs, the date on which the Lohman Site Vise was first on sale is not known, but is believed to be circa 2004.
Milek, B., "Handloading for Hunting" New Products from RCBS, Lee, Accurate Arms, Peterson's Hunting, Mar. 1985, p. 21.
Hyskore: Professional Shooting Accessories, "Dangerous Game Machine Rest," www.hyskore.com, 10 pgs. [Internet accessed Feb. 22, 2006].
Hyskore: Professional Shooting Accessories, "Hydraulic Trigger Release," www.hyskore.com, 7 pgs. [Internet accessed Feb. 22, 2006].
Lahti Company Brochure, "Rock Solid Hold," Rifle Evaluator, http://www.lathicompany.com/Forms/EvaluatorBrochure2.jpg, 2 pgs. [Internet accessed Jan. 16, 2006].
Lahti Company Brochure, "Rifle Evaluator: No Pain, No Fear, No Flinching, No Body Movement," www.lahticompany.com, 2 pgs., Undated.
Lee Precision, Inc., "The World's Fastest Handloading Press . . . Lee Progressive 1000," 1985 Catalog, pp. 1-15.
Lee Precision, Inc., "Load-All," 1 page.
Lyman, "A History of Lyman Metallic Reloading," Reloading Handbook, 46th Edition, pp. 10-31.
Lyman, "Introduction to Reloading," Reloading Handbook, 46th Edition, pp. 170-203.
Carmichael, J., "Reloading for Accuracy," Lyman Reloading Handbook, 46th Edition, pp. 68-77.
Midway USA, "Chapman 27-Piece Deluxe Screwdriver Set," Master Catalog #2 and Reference Guide, 2004, Product # 510-765, p. 440.
Midway USA, "Pachmayr Professional Screwdriver Set," Master Catalog #2 and Reference Guide, 2004, Product #776-936, p. 448.
Midway USA, "Wheeler Engineering Space-Saver Gunsmithing Screwdriver Set," Master Catalog #2 and Reference Guide, 2004, Product #297-593, p. 453.
Midway USA. "Tipton Range Box with Ultimate Rifle, Handgun Cleaning Kit (No Solvents)," http://www.midwayusa.com/rewriteaproduct/135086, The date on which the Tipton Range Box was first on sale is not known, but is believed to be circa 2004, 2 pages.
MTM Case-Gard, "Gun Maintenance Centers," http://www/mtmcase-gard.com/products/shooting/gunm.html, The date on which the MTM Gun Maintenance Center was first on sale is not known, but is believed to be circa 2004, 2 pages [Internet accessed Oct. 11, 2006].
MTM Case-Gard, "Rifle rest and pistol shooting rest," http://www/mtmcase-gard.com/products/shooting/shoo.html, The date on which the MTM Site-In-Clean was first on sale is not known, but is believed to be circa 2004, 3 pages [Internet accessed Oct. 11, 2006].
MTM Case-Gard, "MTM Shoulder-Gard Rifle Rest," Cover Photo for Rest, p. 2.
Caldwells Insta-View 4 Targets, 1 page [product photo].
CV-500, 3 pages [product photos].
Dillon Precision CV-500 Cartridge Case Vibratory Cleaner, 6 pages [product photos].
Lyman Hornady Case Tumbler, 3 pages [product photos].
Lyman Turbo 600 Tumbler, 3 pages [product photos].
Lyman Turbo Pro 1200 Tumbler, 2 pages [product photos].
Auto-Flo Lyman Turbo 1200 Tumbler, 2 pages [product photos].
RCBS Automatic Primer Tool, pp. 68-71, undated.
"Reloading Manual Number Ten for Rifle and Pistol," The Cartridge Components, SPEER Omark Industries, pp. 28-54.
"Shotshell reloading with a Grabber 76," MEC—Mayville Engineering Company, Inc., pp. 1-12.

Sweeney, P "Gunsmithing: Measure Headspace," Peterson's Rifleshooter, http://www.rifleshootermag.com/gunsmithing/headspace_0612/, 4 pages [Internet Accessed Dec. 11, 2004].

Tenex Precision Co., "Recoil A-Rest-R," 4 pages [product photos].

"Plano Shooters Case, Brown Camo," The Sportman's Guide, http://www.sportmansguide.com/cb/cb.asp?a=148225, The date on which the Plano Shooters Case was first on sale is not known but is believed to be circa 2004, 3 pages [Internet accessed on Oct. 11, 2006].

Precision Shooting, Inc., Bald Eagle Front Rest, the Accurate Rifle, vol. 6, Issue No. 4, May 2003, p. 47.

Sinclair International, Sinclair Shooting Rests, Products for the Precision Shooter, 2002, Issue No. 2002-B pp. 76-78.

Device manufactured by Shooter's Ridge, a division of ATK, and available at least by late 2005, 1 page.

"Uncle Bud'S Udder Bag," http:www.unclebudscss.com/pages/Udder%20Bags.html, 2 pgs. [Internet accessed on Feb. 14, 2006].

"Uncle Bud'S Bull Bags," http:www.unclebudscss.com/pages/Bulls%20bags.html, 2 pgs. [Internet accessed on Feb. 14, 2006].

Millett, "BenchMaster Shooting Rests," 1 page, Undated.

Protektor Model, "The Original Leather Rifle and Pistol Rest," http://www.protektormodel.com/, 12 pages [Internet accessed on Feb. 14, 2006].

Edgewood Shooting Bags Catalog, http://www.edgebag.com/catalog.php, 7 pages [Internet accessed on Feb. 14, 2006].

Canadian Camo, "Gun Rest," http://media5.magma.ca/www.canadiancamo.com/catalog/product_info.php?products_id= . . . , 2 pages [Internet accessed on Feb. 13, 2006].

Caldwell Shooting Supplies, 2006 Catalog, pp. 18, 5, 12, 14 and 15.

Cabela's, "Secure Bench Rest," http://www.cabelas.com/cabelas/en/templates/links/link.jsp;jsessionid=4F0LP0OW2HMRLLAQBBISCOF.., © 1996-2008, 2 pages. [Internet accessed on Aug. 6, 2008].

Cabela's, "Premier Rifle Rest," http://www.cabelas.com/cabelas/en/templates/links/link.jsp?id=0020904227856a&type=product&cmCat=.., © 1996-2008, 2 pages [Internet accessed on Aug. 6, 2008].

Cabela's, "Sharp Shooter Rifle Rest," http://www.cabelas.com/cabelas/en/templates/links/link.jsp?id=0005816222738a&type=product&cmCat=, © 1996-2008, 2 pages [Internet accessed on Aug. 6, 2008].

Cabela's, "Nitro Shoulder Shield Rest," http://www.cabelas.com/cabelas/en/templates/links/link.jsp?id=0040862228231a&type=product&cmCat=, © 1996-2008, 2 pages [Internet accessed on Aug. 6, 2008].

Cabela's, "Sure Shot Shooting Vise/Rest," http://www.cabelas.com/cabelas/en/templates/product/standard-item.jsp?id=00348272277 . . . , © 1996-2008, 2 pages [Internet accessed on Jul. 15, 2008].

Cabela's, "BenchBuddy® Gun Rest," http://www.cabelas.com/cabelas/en/templates/links/link.jsp?id=0005819221954a&type=product&cmCat=, © 1996-2008, 2 pages [Internet accessed on Aug. 6, 2008].

Cabela's, "Elite Rifle Rest," http://www.cabelas.com/cabelas/en/templates/links/link.jsp?id=0005817227855a&type=product&cmCat=, © 1996-2008, 2 pages [Internet accessed on Aug. 6, 2008].

Cabela's, "Sharp Shooter Auto Magnum Rifle Rest," http://www.cabelas.com/cabelas/en/templates/links/link.jsp?id=0054107229088a&type=product&cmCat=, © 1996-2008, 2 pages [Internet accessed on Aug. 6, 2008].

Cabela's, "Hyskore® Dangerous Game™ Machine Rest," http://www.cabelas.com/cabelas/en/templates/links/link.jsp?id=0044091228566a&type= product&cmCat=, © 1996-2008, 2 pages [Internet accessed on Aug. 6, 2008].

Cabela's, "Hyskore® Ultimate Sighting Rest," http://www.cabelas.com/cabelas/en/templates/links/link.jsp?id=0024152226083a&type=product&cmCat=, © 1996-2008, 2 pages [Internet accessed on Aug. 6, 2008].

MidwayUSA, "Caldwell Lead Sled Rifle Shooting Rest," http://www.midwayusa.com/eproductpage.exe/showproduct?saleitemid=152664&t=11082005, 2005, 8 pages [Internet accessed on Aug. 6, 2008].

MidwayUSA, "Caldwell Lead Sled DFT Rifle Shooting Rest," http://www.midwayusa.com/eproductpage.exe/showproduct?saleitenn id=149023&t=11082005, 2005, 6 pages [Internet accessed on Aug. 6, 2008].

MidwayUSA, "Caldwell Full Length Fire Control Shooting Rest," http://www.midwayusa.com/eproductpage.exe/showproduct?saleitemid=683866&t=11082005, 2005, 3 pages [Internet accessed on Aug. 6, 2008].

MidwayUSA, "Caldwell Zero-Max Rifle Shooting Rest," http://www.midwayusa.com/eproductpage.exe/showproduct?saleitem id=726222&t=11082005, 2005, 3 pages [Internet accessed on Aug. 6, 2008].

MidwayUSA, "Caldwell Steady Rest NXT Rifle Shooting Rest," http://www.midwayusa.com/eproductpage.exe/showproduct?saleitem id=838651&t=11082005, 2005, 4 pages [Internet accessed on Aug. 6, 2008].

MidwayUSA, "ADG Rifle Shooting Rest," http://www.midwayusa.com/eproductpage.exe/showproduct?saleitemid =992071&t=11082005, 2005, 3 pages [Internet accessed on Aug. 6, 2008].

MidwayUSA, "CTK Precision P3 Ultimate Shooting Rest," http://www.midwayusa.com/eproductpage.exe/showproduct?saleitemid=114699&t=11082005, 2005, 2 pages [Internet accessed on Aug. 6, 2008].

MidwayUSA, "Stoney Point Bench Anchor Rifle Shooting Rest," http://www.midwayusa.com/eproductpage.exe/showproduct?saleitemid=347174&t=11082005, 2005, 2 pages [Internet accessed on Aug. 6, 2008].

MidwayUSA, "Shooters Ridge Steady Point Rifle Shooting Rest," http://www.midwayusa.com/eproductpage.exe/showproduct?saleitemid=826745&t=11082005, 2005, 5 pages [Internet accessed on Aug. 6, 2008].

MidwayUSA, "Shooters Ridge Steady Point Rifle Shooting Rest and Vise," http://www.midwayusa.com/eproductpage.exe/showproduct?saleitemid=341095&t=11082005, 2005, 4 pages [Internet accessed on Aug. 6, 2008].

MidwayUSA, "Hyskore® Precision Gas Dampened Recoil Reducing Rifle Shooting Rest," http://www.midwayusa.com/eproductpage.exe/showproduct?saleitemid=838848&t=11082005, 2005, 4 pages [Internet accessed on Aug. 6, 2008].

MidwayUSA, "Hyskore® Swivel Varmint Rifle Shooting Rest," http://www.midwayusa.com/eproductpage.exe/showproduct?saleitemid=587606&t=11082005, 2005, 3 pages [Internet accessed on Aug. 6, 2008].

MidwayUSA, "Hyskore® dangerous Game Rifle Shooting Rest," http://www.midwayusa.com/eproductpage.exe/showproduct?saleitemid=729197&t=11082005, 2005, 3 pages [Internet accessed on Aug. 6, 2008].

MidwayUSA, "Shooting Supplies—Shop Everything for Your Firearm at MidwayUSA," http://www.midwayusa.com/browse/BrowseProducts.aspx?categoryStrin..., 15 pages [Internet accessed on Jul. 21, 2008].

Basspro.com, "Bass Pro Shops Outdoors Online: Offering the best in Fishing, Hunting and Outdoor Products," http://www.basspro.com/webapp/wcs/stores/servlet/Product_10151_-1_10001_95064 SearchResults, 2 pages [Internet accessed on Aug. 6, 2008].

Amazon.com, "CTK® P3 Ultimate Shooting Rest," Sports & Outdoors, http://www.amazon.com/CTK%C2%AE-P3-Ultimate-Shooting-Rest/dp/..., 1 page. [Internet accessed on Jul. 22, 2008].

Amazon.com, "SHTRS RDG Steady PNT Rifle Rest DLX, Grips/Pads/Stocks, Gun Accessories, Hunting & Shooting Accessories, Hunting Gear, Fishing & Hunting," http://www.amazon.com/STEADY-Accessories-Hunting-Shooting-Fishin..., 1 page [Internet accessed on Jul. 22, 2008].

Amazon.com, "Stoney Point Adjustable Shooting Rest w/Bag," Sports & Outdoors, http://www.amazon.com/Stoney-Point-Adjustable-Shooting-Rest/dp/B0.., 1 page [Internet accessed on Jul. 22, 2008].

CTK Precision, All Products, http://www.ctkprecision.com/index.asp?PageAction=VIEWCATS&Cate.., 3 pages [Internet accessed on Jul. 22, 2008].

CTK Precision, "P3 Ultimate Shooting Rest," http://www.ctkprecision.com/index.asp?PageAction=VIEWPROD&ProdOID=2, 3 pages [Internet accessed on Jul. 18, 2008].

Big Boy Gun Toys, "Shooting Rest," http://www.bigboyguntoys.com/shootingrest.htm, 1 page [Internet accessed on Jul. 18, 2008].
Boyt Harness Company, Product Catalog, http://www.boytharness.com/catalog/index.php?cPath=22, 2 pages [Internet accessed on Jul. 21, 2008].
Joe's, "Shooter's Ridge Steady Point Shooting Rest," http://www.joessport.com/product/index.jsp?productID=3155005&cp=726872&parentpag.., Item No. 3155005, 1 page [Internet accessed Jul. 17, 2008].
Cabela's, "Shooting Benches & Portable Rifle Shooting Bench Rest," http://www.cabelas.com/ssubcat-1/cat20793.shtml, 3 pages [Internet accessed Jul. 18, 2008 ].
"Gun Rest—Shooting Rest—Rifle Rests," http://www.jexploreproducts.com/gunrests-shootingrests.htm, 6 pages [Internet accessed Jul. 18, 2008].
E. Arthur Brown Company, "A Shooting Rest that Really Works..," http://www.eabco.com/TargetShooting01.html, © 2007-2008, 1 page [Internet accessed Jul. 18, 2008].
MacksPW.com, "Desert Mountain Bench Master Rifle Rest," http://www.macksqw.com/Item—i-DESBM1, © 2004-2008, 1 page [Internet accessed Jul. 22, 2008].
Hyskore, "Rest—Dangerous Game Machine Rest," Hyskore Rest, Professional firearm rests, http://www.hyskore.com/rests.htm, 2 pages [Internet accessed Jul. 21, 2008].
Shooters Ridge, "Shooting Rest with Gun Vise," http://www.shootersridge.com, 1 page [Internet accessed Jul. 17, 2008].
Shooters Ridge, "Deluxe Rifle Rest," http://www.shootersridge.com, 1 page [Internet accessed Jul. 21, 2008].
Chastain, R. "Load 'em Up!" About.com: Hunting/Shooting, http://hunting.about.com/od/reloadinfo/a/aaloademup__2htm, 6 pages [Internet accessed on Aug. 31, 2007].
Harris, J. et al., "The Art and Science of Annealing," http://www.6mmbr.com/annealing.html, © 2005, 13 pages [Internet accessed on Aug. 13, 2007].
Cork Industries, Inc., "Double Bumping Coating Applications," Cork Tech TalkNews, Feb. 1997, 2 pages.
Grafix® Plastics, http://www.grafixplastics.com/plastic__film__g.asp?gclid=CK-5-__7gnY4CFRVNhgodjFhfSQ, 29 pages [Internet accessed on Aug. 30, 2007].
International Search Report and Written Opinion; International Patent Application No. PCT/US07/76587; Filed: Aug. 22, 2007; Applicant: Battenfeld Technologies, Inc.; Mailed on Jul. 30, 2008.
International Search Report and Written Opinion; International Patent Application No. PCT/US07/83674; Filed: Nov. 5, 2007; Applicant: Battenfeld Technologies, Inc.; Mailed on Jun. 11, 2008.
Non-Final Office Action; U.S. Appl. No. 10/865,595; Mailed on Jun. 7, 2006, 8 pages.
Final Office Action; U.S. Appl. No. 10/865,595; Mailed on Apr. 3, 2007, 10 pages.
Non-Final Office Action; U.S. Appl. No. 11/206,430; Mailed on May 21, 2007, 12 pages.
Final Office Action; U.S. Appl. No. 11/206,430; Mailed on Oct. 29, 2007, 13 pages.
Non-Final Office Action; U.S. Appl. No. 11/206,430; Mailed on May 14, 2008, 10 pages.
Non-Final Office Action; U.S. Appl. No. 11/271,100; Mailed on Mar. 26, 2008, 9 pages.
Non-Final Office Action; U.S. Appl. No. 11/311,530; Mailed on Feb. 13, 2007, 10 pages.
Non-Final Office Action; U.S. Appl. No. 11/505,784; Mailed on Dec. 26, 2007, 14 pages.
Non-Final Office Action; U.S. Appl. No. 11/679,136; Mailed on Aug. 18, 2008, 6 pages.
Non-Final Office Action; U.S. Appl. No. 11/679,136; Mailed on Aug. 28, 2008, 8 pages.
Non-Final Office Action; U.S. Appl. No. 11/844,980; Mailed on Aug. 21, 2008, 8 pages.
Non-Final Office Action; U.S. Appl. No. 11/846,408; Mailed on Aug. 18, 2008, 8 pages.
U.S. Appl. No. 12/209,113, filed Sep. 11, 2008, Potterfield et al.
U.S. Appl. No. 12/276,223, filed Nov. 21, 2008, Potterfield et al.
U.S. Appl. No. 12/276,229, filed Nov. 21, 2008, Cauley et al.
"Cabela's Rotary Media Separator," http://www.cabelas/en/templates/links/link.jsp;jsessionid=QYVQMKM0P0P5.., 2 pages [Internet accessed Apr. 24, 2007].
Brass Cleaning Kits, http://www.berrysmfg.com/81.php, 1 page [Internet accessed Apr. 24, 2007].
Final Office Action; U.S. Appl. No. 11/206,430; Mailed on Nov. 24, 2008, 28 pages.
Final Office Action; U.S. Appl. No. 11/271,100; Mailed on Sep. 22, 2008, 8 pages.
Final Office Action; U.S. Appl. No. 11/339,863; Mailed on Mar. 10, 2009, 22 pages.
Final Office Action; U.S. Appl. No. 11/505,784; Mailed on Dec. 19, 2008, 10 pages.
International Search Report and Written Opinion; International Patent Application No. PCT/US07/76440; Filed: Aug. 21, 2007; Applicant: Battenfeld Technologies, Inc.; Mailed on Sep. 30, 2008.
Non-Final Office Action; U.S. Appl. No. 11/339,863; Mailed on Sep. 23, 2008, 7 pages.
Non-Final Office Action; U.S. Appl. No. 11/418,407; Mailed on Feb. 24, 2009, 9 pages.
Non-Final Office Action; U.S. Appl. No. 11/431,956; Mailed on Mar. 2, 2009, 16 pages.
Non-Final Office Action; U.S. Appl. No. 11/507,683; Mailed on Sep. 18, 2008, 8 pages.
Non-Final Office Action; U.S. Appl. No. 11/607,550; Mailed on Mar. 2, 2009, 11 pages.
Non-Final Office Action; U.S. Appl. No. 11/801,341; Mailed on Jan. 13, 2009, 7 pages.
Non-Final Office Action; U.S. Appl. No. 11/853,763; Mailed on Dec. 22, 2008, 6 pages.
RCBS, "Reloading Equipment," http://www.rcbs.com/default.asp?menu=1&s1=4&s2=3&s3=25, 1 page [Internet accessed Apr. 24, 2007].
The Blue Press, "Dillon Case Preparation Equipment," http://dillonprecision.com/template/p.cfm?maj=16&min=0&dyn=1&, Apr. 2007, 2 pages [Internet accessed Apr. 24, 2007].
U.S. Appl. No. 12/476,041, filed Jun. 1, 2009, Cauley.
U.S. Appl. No. 12/578,393, filed Oct. 13, 2009, Morrow et al.
U.S. Appl. No. 12/614,578, filed Nov. 9, 2009, Zara.
U.S. Appl. No. 12/623,238, filed Nov. 20, 2009, Potterfield.
Final Office Action; U.S. Appl. No. 11/679,136; Mailed on Apr. 10, 2009, 22 pages.
Final Office Action; U.S. Appl. No. 11/853,763; Mailed on Jul. 13, 2009, 7 pages.
Non-Final Office Action; U.S. Appl. No. 11/679,169; Mailed on Apr. 28, 2009, 11 pages
Non-Final Office Action; U.S. Appl. No. 11/853,745; Mailed on Jun. 19, 2009, 11 pages.
Non-Final Office Action; U.S. Appl. No. 12/117,668; Mailed on Aug. 13, 2009, 15 pages.
Non-Final Office Action; U.S. Appl. No. 11/679,832; Mailed on Aug. 28, 2009, 9 pages.
Final Office Action; U.S. Appl. No. 11/801,341; Mailed on Sep. 30, 2009, 6 pages.
Non-Final Office Action; U.S. Appl. No. 11/206,430; Mailed on Jun. 23, 2009, 13 pages.
Non-Final Office Action; U.S. Appl. No. 11/739,077; Mailed on Oct. 8, 2009, 7 pages
Non-Final Office Action; U.S. Appl. No. 12/209,113; Mailed on Sep. 23, 2009, 6 pages.
Final Office Action; U.S. Appl. No. 11/607,550; Mailed on Nov. 27, 2009, 14 pages.
Non-Final Office Action; U.S. Appl. No. 11/505,784; Mailed on Oct. 27, 2009, 8 pages.
Non-Final Office Action; U.S. Appl. No. 12/476,041; Mailed on Nov. 18, 2009, 6 pages.

* cited by examiner

FIREARM SUPPORTS, SUCH AS SHOOTING BAGS, AND FIREARM SUPPORT ASSEMBLIES

CROSS-REFERENCE TO RELATED APPLICATION

This application claims the benefit of U.S. Provisional Patent Application No. 60/776,296, filed Feb. 24, 2006, which is incorporated by reference herein.

TECHNICAL FIELD

The present disclosure is directed to firearm supports, such as firearm shooting bags, and firearm support assemblies.

BACKGROUND

Shooters often use shooting bags to support a firearm during target practice and accuracy testing. For example, shooters can place the forestock of a rifle on a front bag and the buttstock of the rifle on a rear bag. The front bag is typically larger than the rear bag and can include an arcuate or V-shaped top surface sized to support the forestock of the rifle. The rear bag may include an arcuate or V-shaped surface sized to support the buttstock of the rifle. Other shooting bags are sized to support the entire rifle so that a second bag is not needed. For example, one such shooting bag includes a long U- or V-shaped opening sized to receive several inches of a rifle stock to support the entire rifle. Additional shooting bags have different shapes designed for other applications.

Conventional shooting bags include (a) a fabric or leather cover that encloses an internal cavity, and (b) particulate material filling the entire internal cavity. One drawback of conventional shooting bags is that the bottom portion of each bag tends to round such that the bottom surface of the bag is not planar, but rather slopes upwardly from a central portion of the bottom surface toward a perimeter portion of the bottom surface. As a result, the edges between the bottom surface and the side surfaces are typically spaced apart from the external support surface on which the bag rests. The rounding of the bottom portion of the bag creates instability and enables the bag to shift or move relatively easily under the weight of the firearm. The instability of conventional shooting bags can adversely affect the accuracy and concentration of a shooter. Another drawback of conventional shooting bags is that the bags are expensive to ship. Specifically, the entire internal cavity of the shooting bag must be filled with particulate material to provide the desired shape to the bag. The particulate material is heavy and shipping rates are based in part on the weight of a package. Accordingly, there exists a need to improve conventional shooting bags.

DETAILED DESCRIPTION

A. Overview

Figure 1:
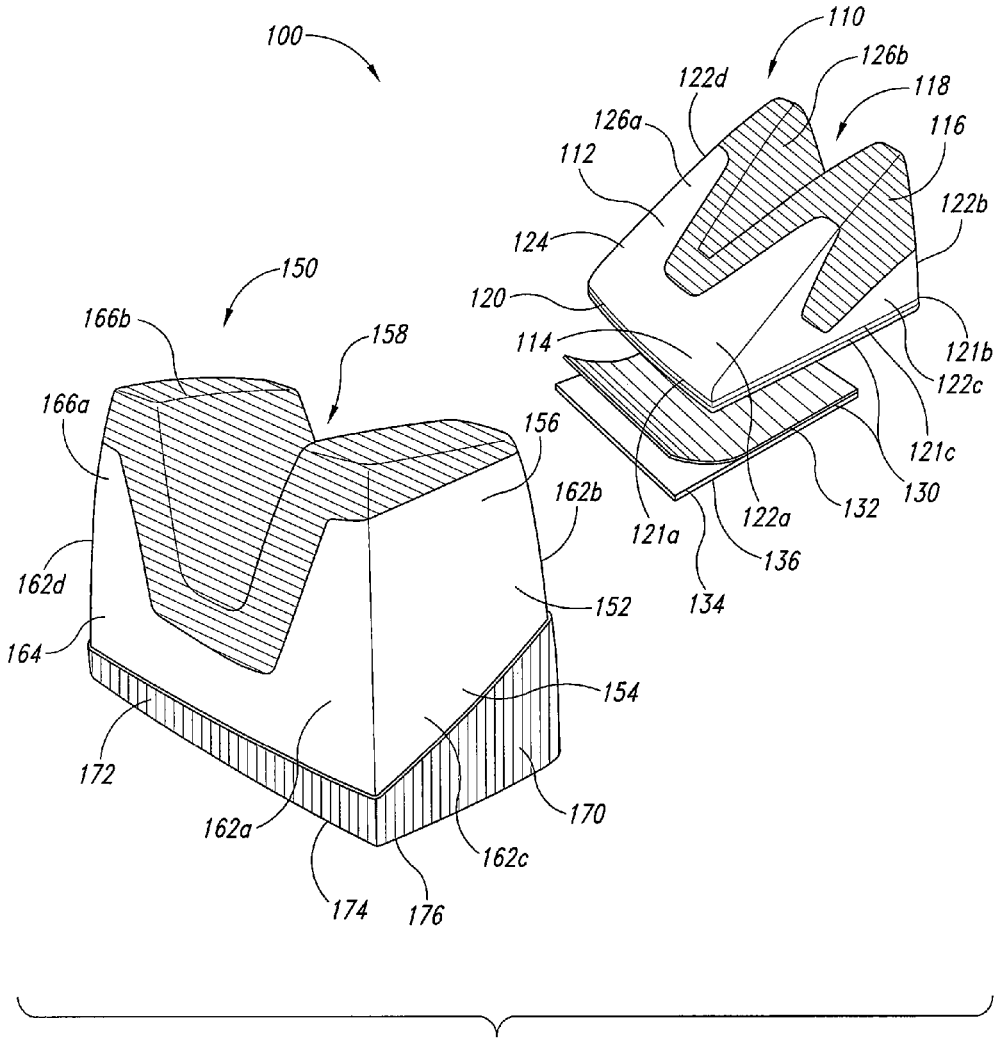
FIG. 1 is a schematic isometric view of a system for supporting a firearm in accordance with one embodiment of the invention.

The following disclosure describes several embodiments of firearm supports (e.g., firearm shooting bags) and firearm support assemblies. One aspect of the invention is directed to a firearm support bag for supporting a firearm. In one embodiment, a firearm support bag includes an at least partially flexible enclosure defining at least a portion of a cavity, a generally rigid support structure positioned at least partially within the cavity, and filler material within the cavity. The enclosure includes an upper portion configured to carry a firearm and a lower portion configured to be positioned at an external support surface.

In another embodiment, a firearm support bag includes a body having a fabric enclosure at least partially enclosing a cavity and filler material in the cavity. The body further includes an upper portion configured to carry a firearm and a lower portion opposite the upper portion. The firearm support bag further includes a molded or cast base attached to the lower portion of the body and positioned to contact an external support surface.

Another aspect of the invention is directed to firearm supports. In one embodiment, a firearm support includes a generally pliable cover at least partially enclosing an internal space, and a generally inflexible support structure coupled to the pliable cover and configured to assist the pliable cover in maintaining a particular shape.

In another embodiment, a firearm support includes a body having an at least partially flexible cover defining at least a portion of a cavity, filler material in the cavity, an upper portion positioned to carry a firearm, and a lower portion opposite the upper portion. The cover has a first flexibility, and the lower portion includes a plurality of edges. The firearm support further includes a base attached to the lower portion and positioned proximate to at least three edges. The base is positioned to contact an external support surface. The base includes a polymeric material and has a second flexibility less than the first flexibility.

Another aspect of the invention is directed to firearm support assemblies for supporting a firearm having a first section and a second section spaced apart from the first section. In one embodiment, a firearm support assembly includes a first support for carrying the first section of the firearm, a second support for carrying the second section of the firearm, and a connector attached to and extending between the first and second supports. The connector includes a flexible section such that the first and second supports can move relative to each other.

Specific details of several embodiments of the invention are described below with reference to firearm supports and firearm support assemblies. Several details describing well-known structures or processes often associated with firearms and firearm supports are not set forth in the following description for purposes of brevity and clarity. Also, several other embodiments of the invention can have different configurations, components, or procedures than those described in this section. A person of ordinary skill in the art, therefore, will accordingly understand that the invention may have other embodiments with additional elements, or the invention may have other embodiments without several of the elements shown and described below with reference to FIGS. 1-11.

Where the context permits, singular or plural terms may also include the plural or singular term, respectively. Moreover, unless the word "or" is expressly limited to mean only a single item exclusive from other items in reference to a list of at least two items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same features and/or other types of features and components are not precluded.

B. Embodiments of Firearm Supports

FIG. 1 is a schematic isometric view of a system 100 for supporting a firearm (not shown) in accordance with one embodiment of the invention. The illustrated system 100 includes a first firearm support 110 and a second firearm support 150 detached and separate from the first support 110. The first and second supports 110 and 150 can be used together to support a single firearm (e.g., a rifle or shotgun). For example, the first support 110 can be a rear bag for supporting a buttstock of a firearm and the second support 150 can be a front bag for supporting the forestock and/or barrel of the firearm. In other applications, the first and second supports 110 and 150 can be used individually or with other bags.

The first support 110 includes a body 112 and a base 130 attached to the body 112 (in FIG. 1 the base 130 is shown attached to the body 112 and spaced apart from the body 112 for illustrative purposes). The body 112 has a lower portion 114 connected to the base 130, an upper portion 116 opposite the lower portion 114, and a recess 118 in the upper portion 116. The upper portion 116 of the body 112 is configured and positioned to support the firearm. Specifically, the recess 118 is sized and configured to at least partially receive a portion of the firearm (e.g., a buttstock). In the illustrated embodiment, the recess 118 has a generally V-shaped configuration to inhibit side-to-side movement of the firearm and support the firearm in an upright position. In other embodiments, the body 112 may not include a recess for receiving a portion of the firearm.

The body 112 further includes a bottom surface 120 facing the base 130, a plurality of side surfaces 122 (identified individually as 122*a-d*) extending between the lower and upper portions 114 and 116, and a plurality of edges 121 (identified individually as 121*a-d*) between the bottom surface 120 and corresponding side surfaces 122. The illustrated side surfaces 122 are canted generally inwardly to provide a functional shape with an aesthetically pleasing appearance. For example, a first side surface 122*a* extends generally inwardly at a first angle relative to the bottom surface 120, a second side surface 122*b* extends generally inwardly at a second angle relative to the bottom surface 120 that is greater than the first angle, a third side surface 122*c* extends generally inwardly at a third angle relative to the bottom surface 120 that is greater than the second angle, and a fourth side surface 122*d* extends generally inwardly at a fourth angle relative to the bottom surface 120 that is approximately equal to the third angle. In other embodiments, however, the body 112 can have different configurations. For example, the body 112 may not include a bottom surface 120, but rather the base 130 can be attached directly to the side surfaces 122.

Figure 2:
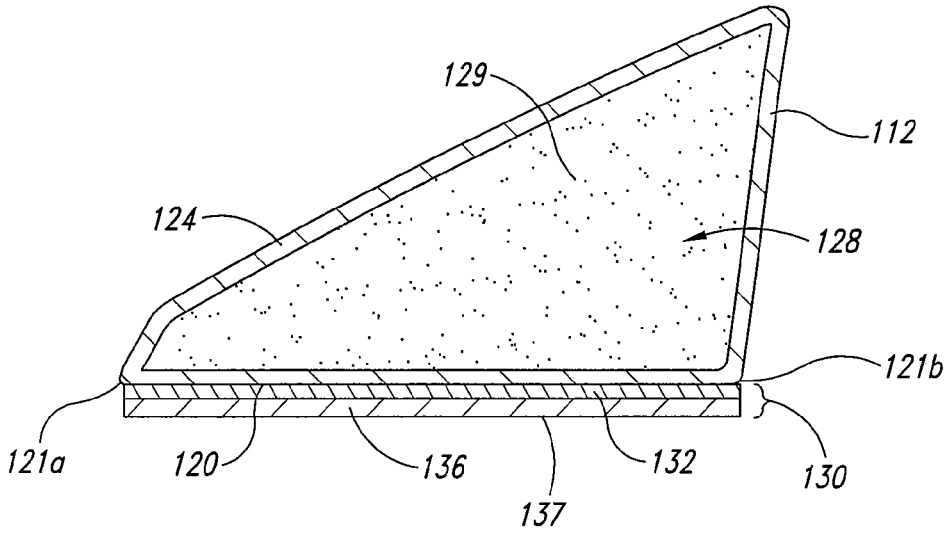
FIG. 2 is a schematic side cross-sectional view of the first firearm support illustrated in FIG. 1.

FIG. 2 is a schematic side cross-sectional view of the first firearm support 110. Referring to both FIGS. 1 and 2, the body 112 further includes a flexible enclosure 124, an internal cavity 128 defined by the enclosure 124, and filler material 129 positioned in the cavity 128. The enclosure 124 can be an inorganic material, such as fabric, or an organic material, such as leather. Furthermore, the enclosure 124 can include multiple portions composed of different materials that are attached together to form the enclosure 124. For example, the illustrated enclosure 124 includes a first portion 126*a* with a first material and a second portion 126*b* with a second, different material attached to the first portion 126*a* by sewing, gluing, riveting, or other suitable attachment methods. In several embodiments, the first portion 126*a* can be composed of fabric, and the second portion 126*b* can be composed of leather, plastic, rubber, or other non-marring materials. Although the first and second portions 126*a* and 126*b* in the illustrated embodiment are composed of generally flexible materials, in other embodiments the first or second portion 126*a* or 126*b* may include a relatively inflexible material. In either case, the filler material 129 can include sand, ground corn cob, dried rice, kitty litter, or other suitable particulate matter. In additional embodiments, such as the embodiments described below with reference to FIGS. 5-7 and 10, the body 112 may further include a generally rigid support structure positioned in the cavity 128 with the filler material 129.

The illustrated base 130 is attached to the body 112 and covers the entire bottom surface 120. Specifically, the base 130 extends across the bottom surface 120 from the first edge 121*a* to the second edge 121*b* and from the third edge 121*c* to the fourth edge 121*d* (not shown). In other embodiments, such as the embodiments described below with reference to FIGS. 3 and 4, the base 130 may not cover the entire bottom surface 120 and/or may cover portions of the side surfaces 122. The illustrated base 130 includes a first layer 132 attached to the bottom surface 120 and a second layer 134 attached to the first layer 132. The first layer 132 can be a generally flexible, foam-like material, and the second layer 134 can be a polymeric material (e.g., rubber or plastic). The illustrated second layer 134 has a generally planar exterior surface 136 positioned to contact an external support surface on which the support 110 can rest. In other embodiments, the base 130 may include a single layer and/or the second layer 134 may include a non-planar exterior surface 137 with surface features (e.g., ribs, projections and/or apertures). In either case, the base 130 can be cast, molded, or otherwise formed and then subsequently attached to the body 120 with adhesive, mechanical fasteners (e.g., rivets or screws), stitches, or other means. Alternatively, the base 130 can be cast, molded, or otherwise constructed directly on the body 112. In additional embodiments, the first support 110 may not include a base attached to the body.

Referring only to FIG. 1, the second support 150 includes a body 152 and a base 170 attached to the body 152. The body 152 has a lower portion 154, an upper portion 156, and a recess 158 in the upper portion 156. The recess 158 is sized and configured to receive a portion of the firearm. For example, the illustrated recess 158 has a generally U-shaped configuration for receiving the barrel and/or forestock of a firearm and generally inhibiting side-to-side movement. The body 152 further includes a plurality of side surfaces 162

(identified individually as 162*a-d*) extending between the lower and upper portions 154 and 156. In the illustrated embodiment, the side surfaces 162 are canted inwardly, upwardly, although in other embodiments the side surfaces 162 may have a different orientation. The body 152 further includes a generally flexible enclosure 164 partially enclosing an internal cavity (not shown) and filler material (not shown) positioned within the cavity. The enclosure 164 can be generally similar to the enclosure 124 described above with reference to the first support 110. For example, the enclosure 164 may include a first portion 166*a* composed of a first material and a second portion 166*b* composed of a different material than the first material.

The illustrated base 170 is attached to the lower portion 154 of the body 152 and includes an upper section 172 and a lower section 174. The upper section 172 is attached to and partially covers the side surfaces 162. The lower section 174 is placed at the bottom of the support 150 and includes an exterior surface 176 positioned to contact an external support surface. In embodiments in which the body 152 includes a bottom surface, the lower section 174 can cover the bottom surface. In other embodiments, however, the base 170 can partially define the internal cavity.

One feature of the first and second firearm supports 110 and 150 is that the enclosures 124 and 164 have a first flexibility and the bases 130 and 170 have a second flexibility less than the first flexibility. An advantage of this feature is that the bases 130 and 170 are expected to increase the stability of the supports 110 and 150. Specifically, because the bases 130 and 170 are less flexible than the enclosures 124 and 164, the bases 130 and 170 are expected to provide a generally flat surface on which each support 110 and 150 can rest, which reduces movement of the supports 110 and 150 during use. This may improve the concentration and accuracy of a shooter.

Figure 3:
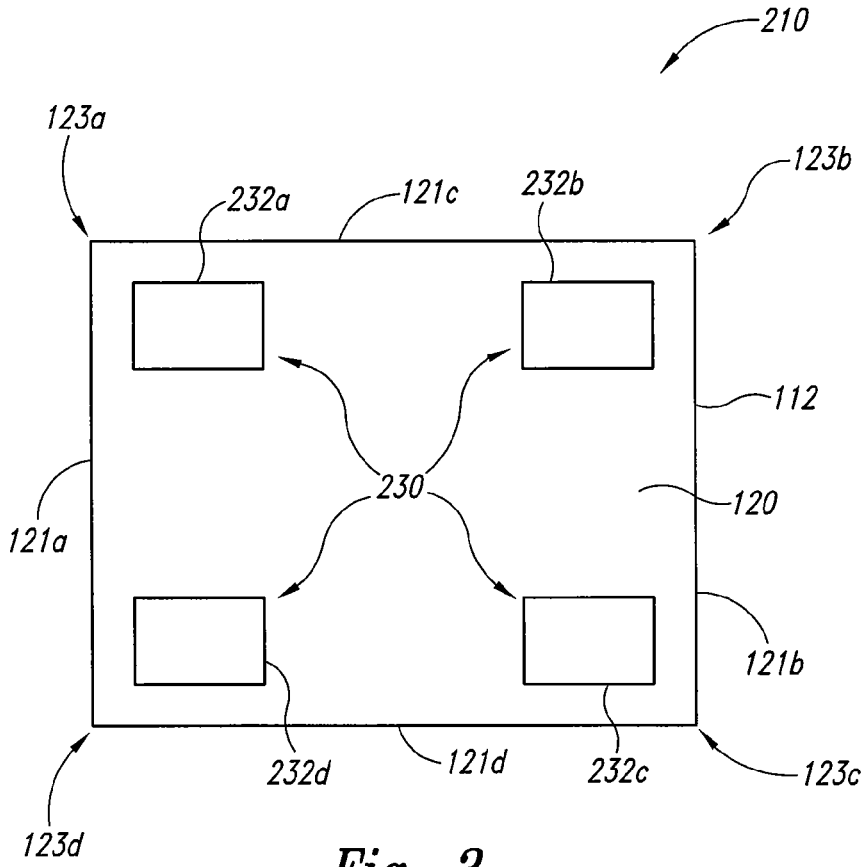
FIG. 3 is a schematic bottom view of a firearm support in accordance with another embodiment of the invention.

FIG. 3 is a schematic bottom view of a firearm support 210 in accordance with another embodiment of the invention. The firearm support 210 is generally similar to the first firearm support 110 described above with reference to FIGS. 1 and 2. For example, the firearm support 210 includes a body 112 and a base 230 attached to the body 112. The illustrated base 230, however, includes a plurality of discrete and spaced-apart portions 232 (identified individually as 232*a-d*). Specifically, the base 230 includes a first portion 232*a* at a first corner 123*a* of the bottom surface 120, a second portion 232*b* at a second corner 123*b* of the bottom surface 120, a third portion 232*c* at a third corner 123*c* of the bottom surface 120, and a fourth portion 232*d* at a fourth corner 123*d* of the bottom surface 120. The illustrated portions 232*a-d* are non-removably attached to the body 112 and project from the bottom surface 120. In other embodiments, the individual portions 232*a-d* of the base 230 can include a bushing attached to the body 112 and a foot removably attached to the bushing. Moreover, although the illustrated portions 232*a-d* are positioned at a perimeter section of the bottom surface 120, in other embodiments the base 230 can include one or more portions at a central section of the bottom surface 120.

Figure 4:
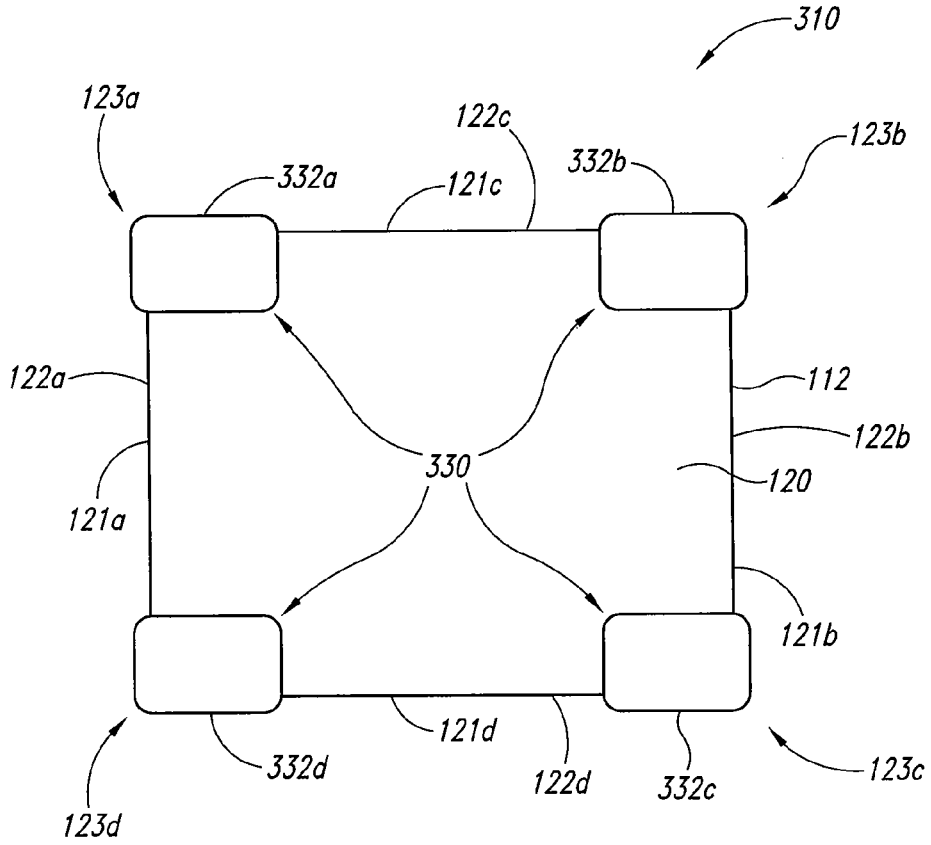
FIG. 4 is a schematic bottom view of a firearm support in accordance with another embodiment of the invention.

FIG. 4 is a schematic bottom view of a firearm support 310 in accordance with another embodiment of the invention. The illustrated firearm support 310 is generally similar to the firearm support 210 described above with reference to FIG. 3. For example, the firearm support 310 includes a body 112 and a base 330 with a plurality of portions 332 attached at corresponding corners 123 of the bottom surface 120. The illustrated portions 332, however, extend around the edges 121 and cover a portion of the side surfaces 122. In other embodiments, the base 330 may be a single member that extends across the entire bottom surface 120 and partially covers one or more side surfaces 122.

Figure 5:
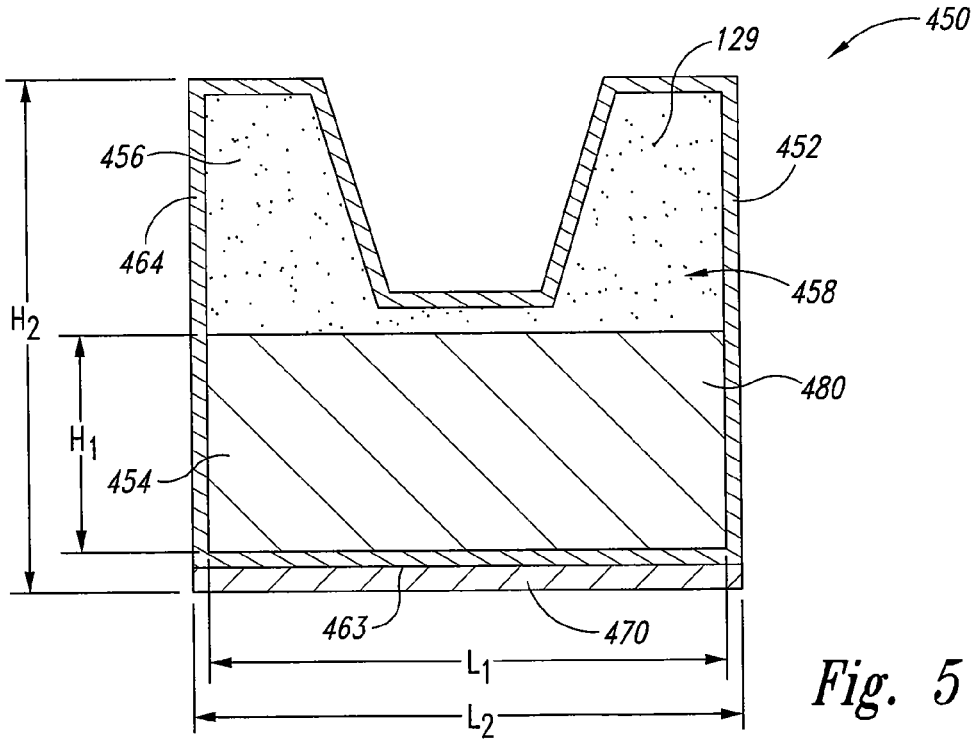
FIG. 5 is a schematic side cross-sectional view of a firearm support in accordance with another embodiment of the invention.

FIG. 5 is a schematic side cross-sectional view of a firearm support 450 in accordance with another embodiment of the invention. The illustrated firearm support 450 is generally similar to the second firearm support 150 described above with reference to FIG. 1. For example, the firearm support 450 includes a base 470 and a body 452 having a lower portion 454, an upper portion 456, a generally flexible enclosure 464, and a cavity 458 defined by the enclosure 464. In the illustrated embodiment, however, the enclosure 464 is a single member that completely encloses the cavity 458, and the base 470 covers only a bottom surface 463 of the body 452. Moreover, the illustrated body 452 further includes a generally rigid support structure 480 in a lower portion of the cavity 458 and filler material 129 in an upper portion of the cavity 458. The support structure 480 assists the body 452 in maintaining its shape and reduces the volume of filler material 129 required to fill the body 452. For example, the support structure 480 can fill 25% or more (e.g., 50% or 75%) of the volume of the cavity 458 so that the filler material 129 need only fill 75% or less (e.g., 50% or 25%) of the volume of the cavity 458. The support structure 480 may also have a length $L_1$ 25% or more (e.g., 50% or 75%) of a length $L_2$ of the firearm support 450, and a height $H_1$ 25% or more (e.g., 50% or 75%) of a height $H_2$ of the firearm support 450. In other embodiments, however, the support structure 480 may fill less than 25% of the cavity 458, and/or the support structure 480 can have a length $L_1$ and/or height $H_1$ less than 25% of the length $L_2$ and/or height $H_2$, respectively, of the firearm support 450.

The support structure 480 may be constructed of a material selected to increase or reduce the weight of the firearm support 450. For example, the support structure 480 can be a generally rigid foam block in applications in which reduced weight is desired. An advantage of foam and other light-weight materials is that the reduced weight of the support structure 480 reduces the cost to ship the firearm support 450 because shipping rates are based in part on the weight of the package. In other embodiments, however, the support structure 480 can be composed of plastic, metal, wood, or other suitable materials that may or may not be light-weight materials.

Figure 6:
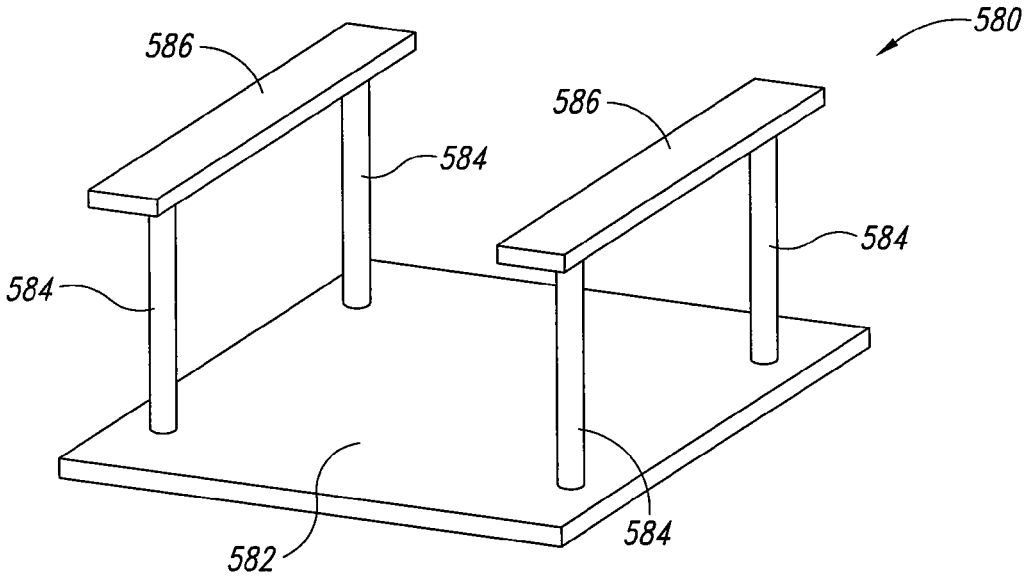
FIG. 6 is a schematic isometric view of a support structure for use in a firearm support in accordance with another embodiment of the invention.

FIG. 6 is a schematic isometric view of a support structure 580 for use in a firearm support in accordance with another embodiment of the invention. The illustrated support structure 580 is sized and configured to fit within the cavity of a firearm support such as the second firearm support 150 illustrated in FIG. 1 or the firearm support 450 illustrated in FIG. 5. The support structure 580 includes a plate 582, a plurality of columns 584 projecting from the plate 582, and a plurality of support members 586 attached to corresponding pairs of columns 584. The support members 586 are sized and positioned to contact the interior surface of the flexible enclosure and provide support to the enclosure so that the body maintains its shape. The remainder of the cavity may or may not be filled with filler material or another generally rigid support structure. As a result, the illustrated support structure 580 assists the body in maintaining its shape but does not significantly reduce the volume of filler material required to fill the body.

Figure 7:
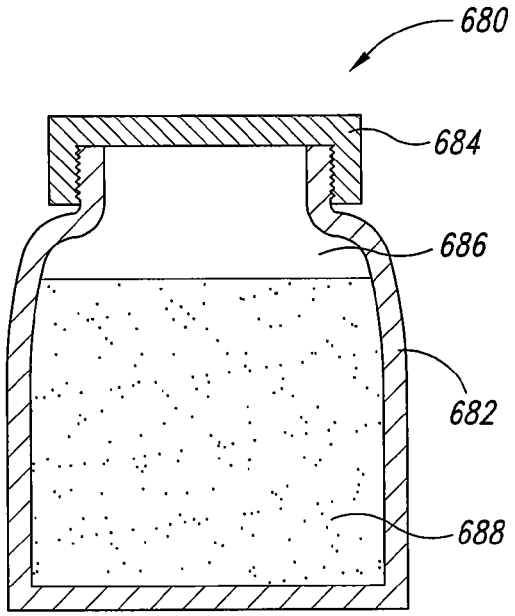
FIG. 7 is a schematic side cross-sectional view of a support structure for use in a firearm support in accordance with another embodiment of the invention.

FIG. 7 is a schematic side cross-sectional view of a support structure 680 for use in a firearm support in accordance with another embodiment of the invention. The illustrated support structure 680 includes a container 682 and a lid 684 releasably engaged with the container 682. The container 682 defines a compartment 686 partially filled with filler material 688 (e.g., lead shot) to increase the weight of the firearm support. Alternatively, the compartment 686 may include only air or another light-weight material to reduce the weight of the firearm support.

Figure 8:
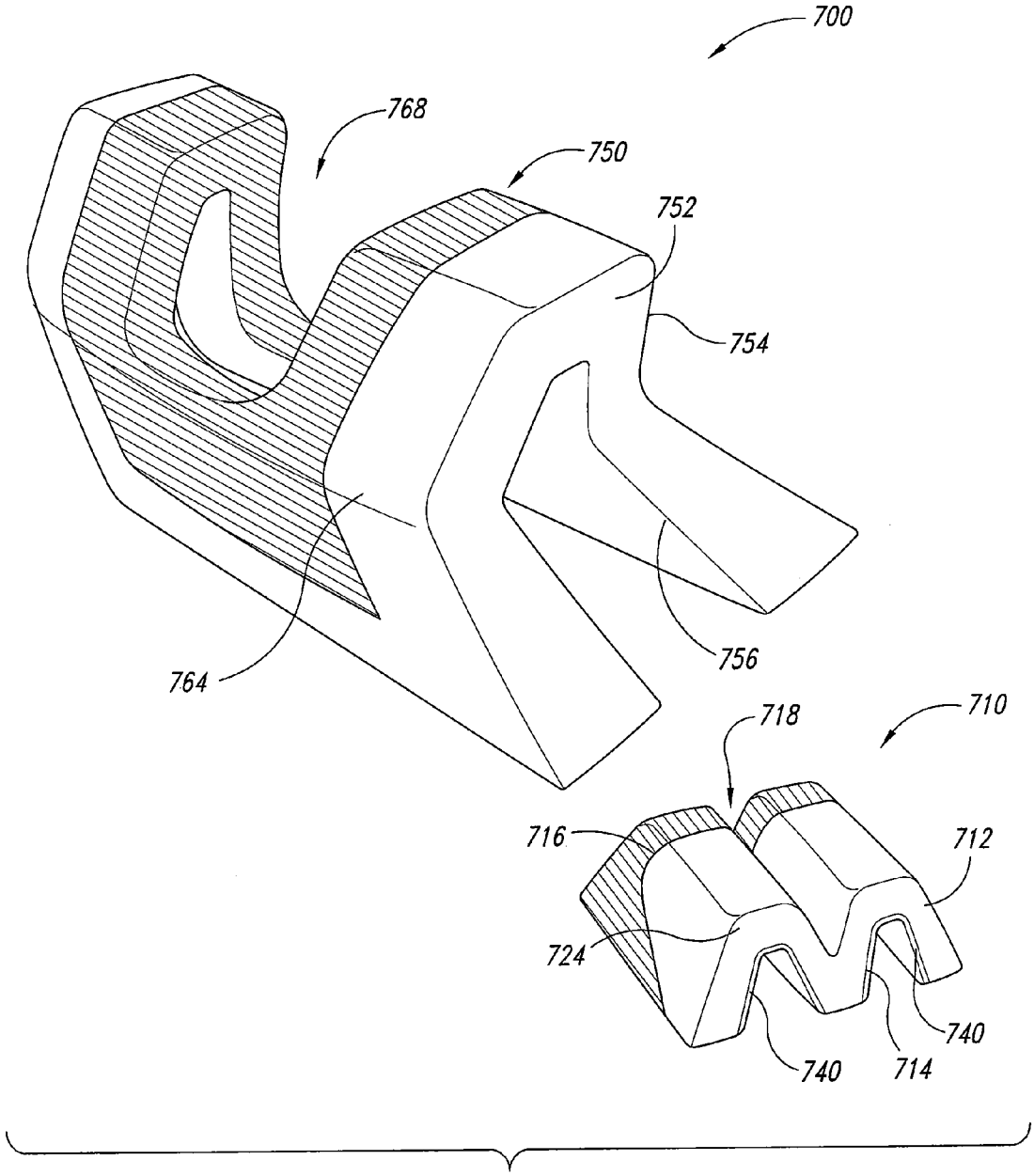
FIG. 8 is a schematic isometric view of a system for supporting a firearm in accordance with another embodiment of the invention.
Figure 9:
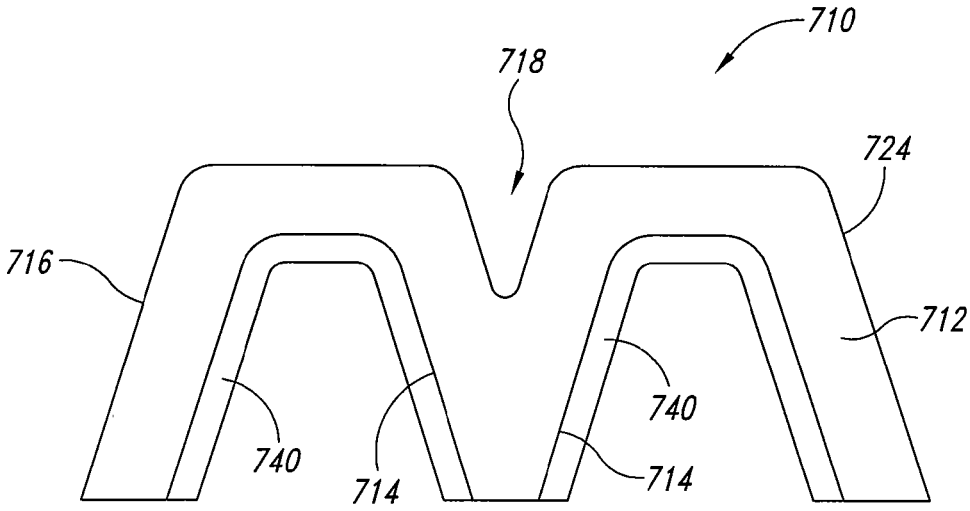
FIG. 9 is a schematic front view of the first firearm support illustrated in FIG. 8.

FIG. 8 is a schematic isometric view of a system 700 for supporting a firearm in accordance with another embodiment of the invention. The system 700 includes a first firearm support 710 and a second firearm support 750 detached and separate from the first firearm support 710. FIG. 9 is a schematic front view of the first firearm support 710 of FIG. 8. Referring to both FIGS. 8 and 9, the first firearm support 710 includes a body 712 and a generally rigid support structure 740 attached to the body 712. The body 712 has a generally M-shaped configuration, and includes an enclosure 724, filler material (not shown) within the enclosure 724, a lower exterior surface 714 facing generally toward an external support surface, and an upper exterior surface 716 opposite the lower surface 714. The upper surface 716 defines a recess 718 sized and configured to receive a portion of the firearm. The support structure 740 is non-removably attached to the lower exterior surface 714 and positioned external to the enclosure 724. The support structure 740 enables the body 712 to maintain a shape that may not be possible with conventional shooting bags. In other embodiments, the support structure 740 can be removably attached to the enclosure 724, and/or disposed within the enclosure 724. In additional embodiments, the firearm support 710 may also include a base attached to the lower portion of the body 712.

Figure 10:
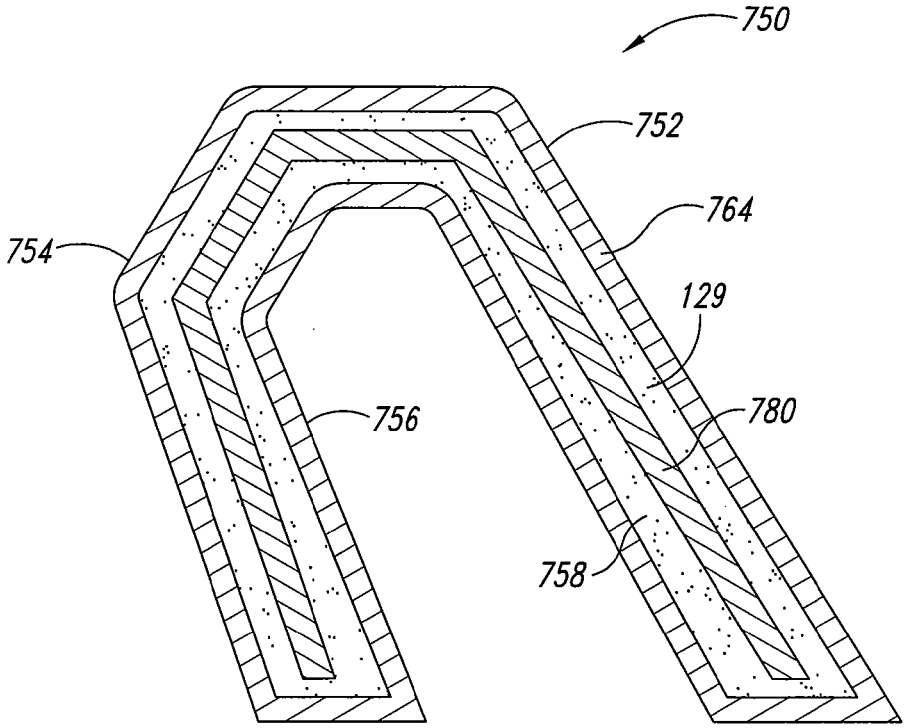
FIG. 10 is a schematic side cross-sectional view of the second firearm support illustrated in FIG. 8.

FIG. 10 is a schematic side cross-sectional view of the second firearm support 750 illustrated in FIG. 8. Referring to both FIGS. 8 and 10, the second firearm support 750 is generally similar to the second firearm support 150 described above with reference to FIG. 1. For example, the second support 750 includes a body 752 having an enclosure 764 defining a cavity 758. The body 752, however, has a generally inverted and angled U-shaped configuration with an outer exterior surface 754, an inner exterior surface 756, and a recess 768 sized to receive a portion of the firearm. The illustrated body 752 further includes a generally rigid support structure 780 with a configuration generally similar to the configuration of the body 752. The support structure 780 is positioned in the cavity 758 and may be spaced apart from the enclosure 764 by a gap that is filled with filler material 129. In other embodiments, the support structure 780 can be attached directly to an interior or exterior surface of the enclosure 764, and/or the second firearm support may include a base attached to the body 752.

Figure 11:
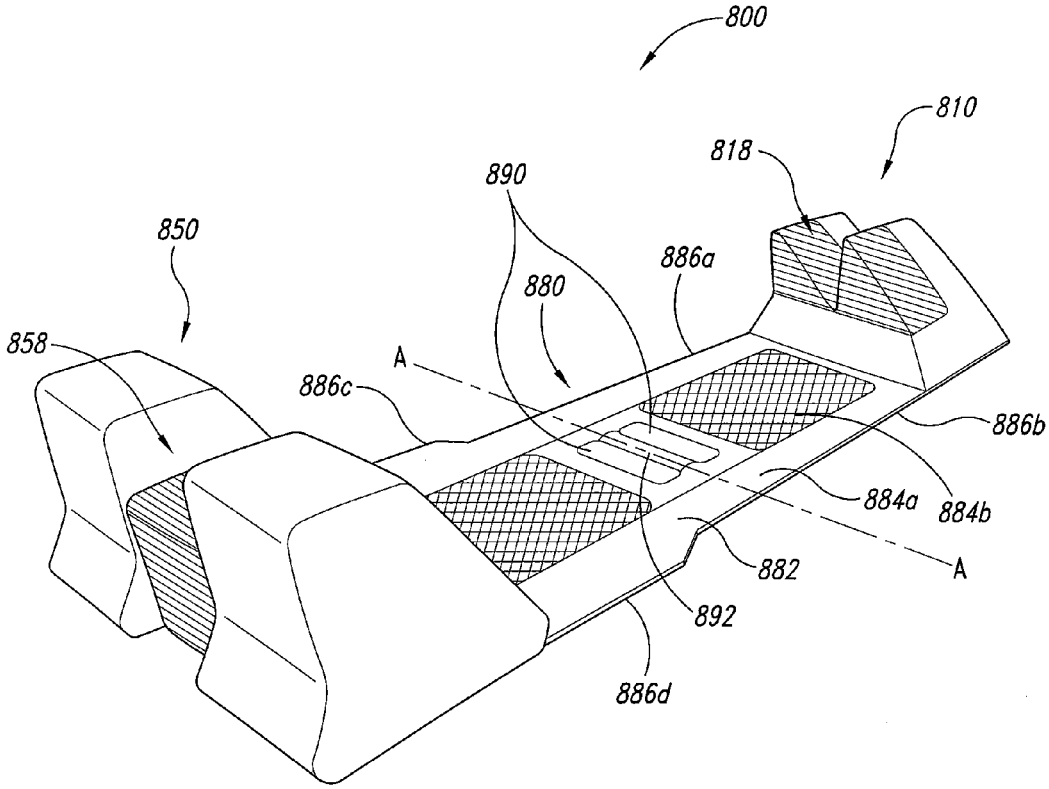
FIG. 11 is a schematic isometric view of a firearm support assembly in accordance with another embodiment of the invention.

FIG. 11 is a schematic isometric view of a firearm support assembly 800 in accordance with another embodiment of the invention. The firearm support assembly 800 includes a first firearm support 810, a second firearm support 850, and a connector 880 extending between the first and second supports 810 and 850. The first and second supports 810 and 850 can be generally similar to any one of the firearm supports described above with reference to FIGS. 1-10. For example, the first support 810 includes a recess 818 sized to receive a first portion of a firearm, and the second support 850 includes a recess 858 sized to receive a second portion of the firearm. The first and second supports 810 and 850 may also include a flexible enclosure that at least partially defines an internal cavity, which may be filled with filler material and/or a generally rigid support structure.

The illustrated connector 880 is non-removably attached to the first and second supports 810 and 850 and includes a generally flexible member 882 defining a plane. The generally flexible member 882 includes a first portion 884*a* comprised of a first material and a second portion 884*b* comprised of a second material. For example, the first portion 884*a* may be composed of canvas or another flexible fabric, and the second portion 884*b* may be composed of a mesh or other suitable material. In other embodiments, the flexible member 882 can be composed of a single material. The illustrated connector 880 further includes a plurality of generally rigid members (e.g., poles) extending along corresponding edges 886 (identified individually as 886*a-d*) of the flexible member 882. For example, a first generally rigid member (not shown) can be attached at a first edge 886*a* and extend from the first support 810 toward the center of the flexible member 882, a second generally rigid member (not shown) can be attached at a second edge 886*b* and extend from the first support 810 toward the center of the flexible member 882, a third generally rigid member (not shown) can be attached at a third edge 886*c* and extend from the second support 850 toward the center of the flexible member 882, and a fourth generally rigid member (not shown) can be attached at a fourth edge 886*d* and extend from the second support 850 toward the center of the flexible member 882. The generally rigid members can assist in properly aligning the first and second supports 810 and 850, but may not inhibit the connector 880 from bending about an axis A-A at the center of the flexible member 882. The connector 880 may further include two apertures 890 and a handle 892 between the apertures 890 for a user to grasp. Because the connector 880 is flexible at the axis A-A, when a user grasps the handle 892 and picks up the firearm support assembly 800, the first and second supports 810 and 850 move toward each other and the support assembly 800 folds in half to facilitate transport. In other embodiments, the first and second supports 810 and 850 can have a different configuration. In additional embodiments, the connector 880 can be removably attached to the supports.

From the foregoing, it will be appreciated that specific embodiments of the invention have been described herein for purposes of illustration, but that various modifications may be made without deviating from the invention. Furthermore, aspects of the invention described in the context of particular embodiments may be combined or eliminated in other embodiments. Further, while advantages associated with certain embodiments of the invention have been described in the context of those embodiments, other embodiments may also exhibit such advantages, and not all embodiments need necessarily exhibit such advantages to fall within the scope of the invention. Accordingly, the invention is not limited, except as by the appended claims.

We claim:

1. A firearm support, consisting of:

a first body including an at least partially flexible first cover defining at least a portion of a first cavity, filler material in the first cavity, a first upper portion positioned to carry a first section of a firearm, and a first lower portion opposite the first upper portion, the first cover having a first flexibility, the first lower portion including a plurality of edges;

a first base attached to the first lower portion and positioned proximate to at least three edges, the first base being positioned to contact an external support surface, the first base including a polymeric material and having a second flexibility less than the first flexibility;

a second body including an at least partially flexible second cover defining at least a portion of a second cavity, filler material in the second cavity, a second upper portion positioned to carry a second section of a firearm, and a second lower portion opposite the second upper portion, the second cover having the first flexibility, the second lower portion including a plurality of edges; and a second base attached to the second lower portion and positioned proximate to at least three edges, the second base being positioned to contact the external support surface, the second base including a polymeric material and having the second flexibility less than the first flexibility, wherein the first base and the second base are not connected.

2. The firearm support of claim 1 wherein:

the first lower portion of the first body further includes a first bottom surface;

the first base covers at least approximately the entire first bottom surface;

the second lower portion of the second body further includes a second bottom surface; and the second base covers at least approximately the entire second bottom surface.

3. The firearm support of claim 1 wherein:

the first lower portion of the first body further includes a first bottom surface with a first plurality of corners;

the first base is attached to the first bottom surface at the corners;

the second lower portion of the second body further includes a second bottom surface with a second plurality of corners; and the second base is attached to the second bottom surface at the corners

4. The firearm support of claim 1 wherein the first and second bases include generally planar surfaces for contacting the external support surface.

5. The firearm support of claim 1 wherein the first and second bases comprise molded or cast bases.

6. The firearm support of claim 1 wherein the covers of the first and second bodies comprise an inorganic material.

7. The firearm support of claim 1 wherein the first and second at least partially flexible covers comprise a fabric cover.

8. The firearm support of claim 1 wherein:

the first and second bodies further includes a side surface extending between the upper and lower portions; and the first and second bases cover a portion of the side surface.

9. A firearm support bag consisting of:

a first body including a fabric enclosure at least partially enclosing a cavity and filler material in the cavity, the first body further including a first upper portion configured to carry a first portion of a firearm and a first lower portion opposite the upper portion;

a first molded or cast base attached to the first lower portion of the first body and positioned to contact an external support surface;

a second body including a fabric enclosure at least partially enclosing a cavity and filler material in the cavity, the second body further including a second upper portion configured to carry a second portion of a firearm and a second lower portion opposite the upper portion; and a second molded or cast base attached to the second lower portion of the second body and positioned to contact the external support surface, wherein the first base and the second base are independent and separate.

10. The firearm support bag of claim 9 wherein:

the first lower portion of the first body includes a bottom surface; and the first molded or cast base is attached to the bottom surface and covers at least approximately the entire bottom surface the second lower portion of the second body includes a bottom surface; and the second molded or cast base is attached to the bottom surface and covers at least approximately the entire bottom surface.

11. The firearm support bag of claim 9 wherein:

the first and second bodies further includes side surfaces extending between the first and second upper and lower portions; and the first and second molded or cast bases covers portions of the side surfaces.

* * * * *

UNITED STATES PATENT AND TRADEMARK OFFICE

CERTIFICATE OF CORRECTION

PATENT NO. : 8,104,212 B2
APPLICATION NO. : 11/679100
DATED : January 31, 2012
INVENTOR(S) : Russell A. Potterfield et al.

It is certified that error appears in the above-identified patent and that said Letters Patent is hereby corrected as shown below:

On Title page 5, in column 1, item [56] under "Other Publications", line 15, delete "Sinclaire" and insert -- Sinclair --, therefor.

On Title page 5, in column 2, item [56] under "Other Publications", line 49, delete "/gunm.html," and insert -- /gun.html, --, therefor.

Column 9, line 30, in claim 3, delete "corners" and insert -- corners. --, therefor.

Column 10, line 2, in claim 8, delete "includes" and insert -- include --, therefor.

Column 10, line 6, in claim 9, delete "bag" and insert -- bag, --, therefor.

Column 10, line 36, in claim 11, delete "includes" and insert -- include --, therefor.

Column 10, line 39, in claim 11, delete "covers" and insert -- cover --, therefor.

Signed and Sealed this
Twenty-ninth Day of May, 2012

David J. Kappos

David J. Kappos
*Director of the United States Patent and Trademark Office*